US005649631A

United States Patent [19]

Loflin

[11] Patent Number: 5,649,631

[45] Date of Patent: Jul. 22, 1997

[54] DISPLAY RACK FOR DISPLAYING ROLLS OF MATERIAL AND METHOD OF DISPENSING MATERIAL THEREFROM

[76] Inventor: Gary W. Loflin, 722-2A Salem St., Thomasville, N.C. 27360

[21] Appl. No.: 421,545

[22] Filed: Apr. 13, 1995

Related U.S. Application Data

[63] Continuation-in-part of Ser. No. 35,248, Feb. 23, 1995, and Ser. No. 35,249, Feb. 23, 1995.

[51] Int. Cl.[6] ..... A47F 7/18

[52] U.S. Cl. ..... 211/44; 211/48; 211/168

[58] Field of Search ..... 211/47, 48, 168, 211/169, 165, 44

[56] References Cited

U.S. PATENT DOCUMENTS

| | | | |
|---|---|---|---|
| D. 165,194 | 11/1951 | Schiffer . | |
| D. 206,037 | 10/1966 | Best . | |
| D. 260,466 | 9/1981 | Butcher et al. . | |
| 292,199 | 1/1884 | Bellinger | 211/168 |
| D. 314,482 | 2/1991 | Walter et al. . | |
| 1,699,025 | 1/1929 | Schulz . | |
| 2,008,215 | 7/1935 | Kennedy . | |
| 2,123,774 | 7/1938 | Forthoffer . | |
| 2,271,346 | 1/1942 | Rosenberger . | |
| 2,742,161 | 4/1956 | Nuttall . | |
| 2,919,812 | 1/1960 | Best et al. . | |
| 2,946,454 | 7/1960 | Asher . | |
| 2,975,904 | 3/1961 | Krebs et al. . | |
| 3,106,920 | 10/1963 | Scholfield et al. . | |
| 3,185,309 | 5/1965 | Radek . | |
| 3,191,776 | 6/1965 | Tokash . | |
| 3,195,733 | 7/1965 | Best . | |
| 3,208,598 | 9/1965 | Glassenberg . | |
| 3,235,093 | 2/1966 | Eisbart et al. . | |
| 3,272,345 | 9/1966 | Wallace . | |
| 3,627,141 | 12/1971 | Kurland . | |
| 3,631,975 | 1/1972 | Lefkowitz . | |
| 3,633,759 | 1/1972 | Jennings . | |
| 3,661,269 | 5/1972 | Scherzer . | |
| 3,739,918 | 6/1973 | Kreitzburg . | |
| 3,759,398 | 9/1973 | Romney . | |
| 3,871,524 | 3/1975 | Helf . | |
| 3,924,749 | 12/1975 | Weston | 211/169 X |
| 3,935,949 | 2/1976 | Cohen . | |
| 3,965,583 | 6/1976 | Price . | |

(List continued on next page.)

FOREIGN PATENT DOCUMENTS

| | | |
|---|---|---|
| 739794 | 8/1966 | Canada . |
| 2176694 | 6/1985 | United Kingdom . |

OTHER PUBLICATIONS

Display system utilizing permanently mounted pipes, 1502 Fabrics (Retail Store), High Point, North Carolina, believed by inventor to be used as early as 1975.

Declaration of Gary W. Loflin.

Prior Commercial Embodiment illustrated in sketch provided by Applicant; used, e.g., at 1502 Fabrics (Retail Store), High Piont, North Carolina, believed by inventor to be used as early as 1981.

*Primary Examiner*—Creighton Smith

*Attorney, Agent, or Firm*—Allen, Dyer, Doppelt, Milbrath & Gilchrist, P.A.

[57] ABSTRACT

An apparatus and method for displaying and dispensing rolls of material are provided. The apparatus preferably has a carrier including a plurality of carrier units. Each carrier unit preferably includes a substantially rectangular frame pivotally mounted about a vertical axis extending substantially along a corresponding one of the vertical sides of the frame. The respective vertical axes of the carrier units are mounted in spaced relation to adjacent vertical axes along the carrier. The plurality of carrier units preferably are pivotably movable from a normal inward closed position wherein only a portion of each but one of the endmost carrier units is exposed to an outward open position wherein each carrier unit is fully exposed. A plurality of opposing vertical rows of cooperating roll supports positioned along opposing vertical sides of the frame of each carrier unit and adapted to support a plurality of correspondingly spaced horizontally disposed rolls of material.

35 Claims, 15 Drawing Sheets

U.S. PATENT DOCUMENTS 3,984,002 10/1976 Howard .
4,018,340 4/1977 Gold .
4,063,648 12/1977 Fuller et al. .
4,103,778 8/1978 Bradshaw .
4,192,563 3/1980 Levkovitch .
4,232,791 11/1980 Howard .
4,256,043 3/1981 Ovitz, III .
4,331,245 5/1982 Schell .
4,446,973 5/1984 Fuller et al. .
4,714,165 12/1987 Solomon .
4,756,693 7/1988 Matsuno .
4,936,471 6/1990 Walter .
5,292,011 3/1994 Kostigian ..... 211/48

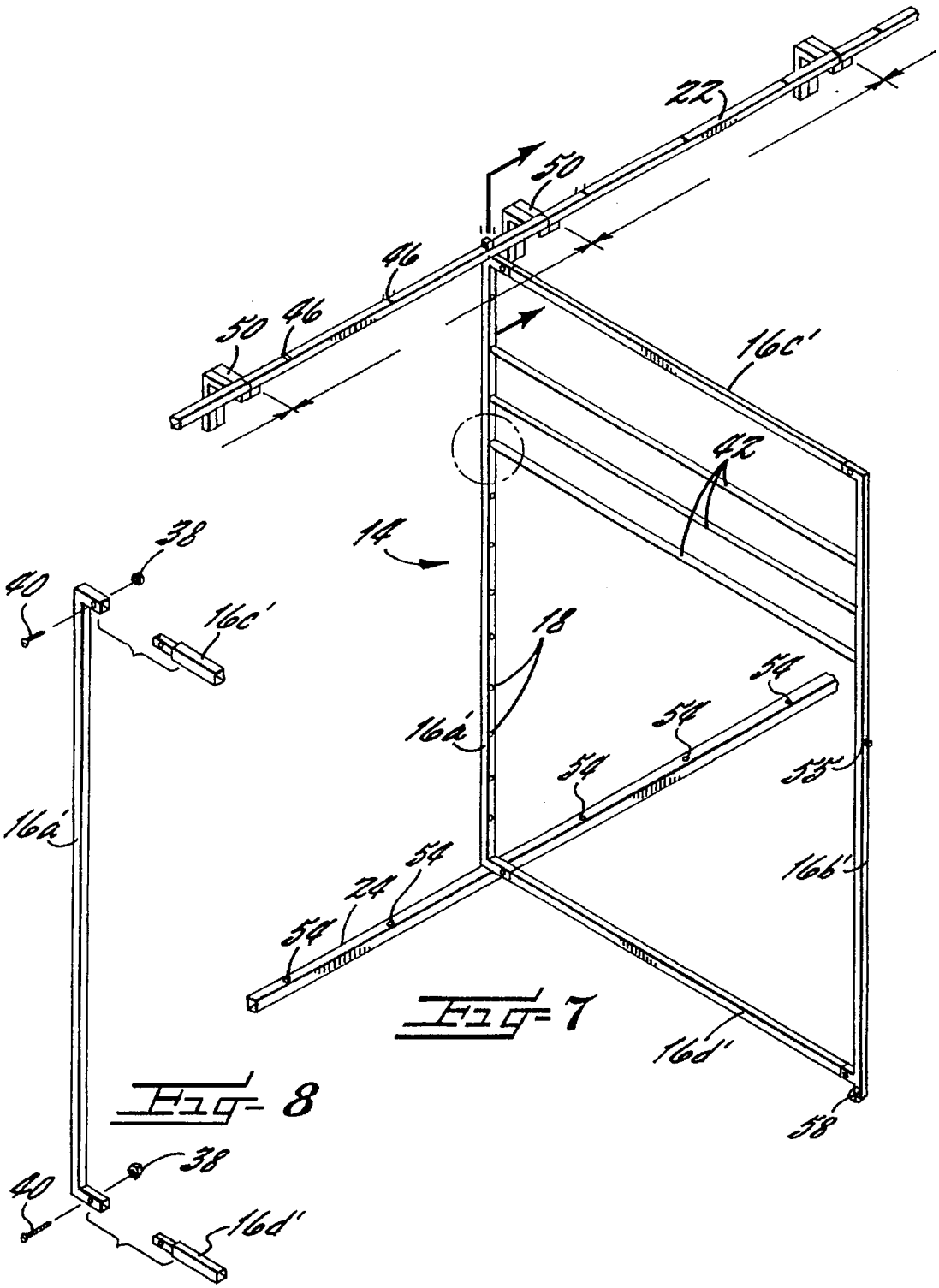
Fig-7
Fig-8
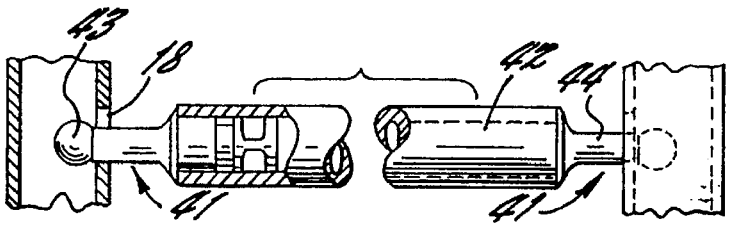
Fig-9

DISPLAY RACK FOR DISPLAYING ROLLS OF MATERIAL AND METHOD OF DISPENSING MATERIAL THEREFROM

RELATED APPLICATION

This application is a continuation-in-part of co-pending application Ser. No. 29/035,248 and Ser. No. 29/035,249 both filed Feb. 23, 1995.

FIELD Of THE INVENTION

The present invention relates to an apparatus for displaying rolls of material and distributing material therefrom and a method for displaying rolls of material and distributing material therefrom.

BACKGROUND OF THE INVENTION

Materials such as fabrics and wallpaper, for example, are commonly displayed in retail stores in the rolled form in which they are provided by the producer. Because these rolls are often quite sizable, however, the display of the rolls can require a great amount of store floor space. Therefore, the number of rolls of material which have been able to be displayed by a store has been limited greatly due to space constraints of the store.

Conventionally, rolls of fabric are displayed on A-frame racks. The racks include a plurality of rods mounted horizontally thereon and a roll of fabric is placed on each rod in order to be mounted on the rack. The rolls are mounted one above the other in a vertically spaced relationship. While this method of display allows a good view of the fabric, this requires a great deal of space since the height of the racks is limited due to visibility requirements of the consumers and the width must be such that the wide rolls of fabric can be accommodated. For example, rolls of fabric typically are provided in standard widths of 54 and 60 inches wide; therefore the display of the rolls can be extremely space consuming. The distribution of fabric material from these racks requires that the clerk remove the fabric roll from the rack and carry it to a cutting table, where the fabric is measured, and cut to the desired length. The roll must then be remounted onto the rack by the clerk.

This material distribution method, however, can represent significant problems. For example, the removal of the roll can be difficult and even dangerous for the clerk, particularly if the roll is mounted near the top of the rack, because of the roll weight and size. Because the clerks must be able to reach the top rolls and remove them from the rack, the height of the rack is extremely limited. In addition, the necessity for cutting tables results in the waste of valuable store floor space. Further, the excess handling of the fabric rolls often results in the fabric or other rolled goods becoming soiled and therefore unsalable.

Another common technique of displaying fabric is in bolt form wherein the fabrics conventionally are folded in half, then wrapped around a rectangular cardboard support. The bolts of fabric are then typically placed side-by-side in a vertical position in a rack. This technique, however, fails to provide good visibility of the fabrics, and the fabrics can become damaged when the bolts are placed in and removed from the racks. In addition, because the customers themselves often remove and replace the bolts, it can be difficult to maintain the fabrics in a selected arrangement or even in the desired rack. In order to distribute the fabric, the bolts are lifted out of the frame and carried to a cutting table where the fabric is then unrolled, measured and cut to the desired length. Because this can be physically taxing to the store clerks, the risk of injury is increased. Further, the necessity for having periodically spaced cutting tables represents a great waste of floor space for the store.

Neither the rack nor the bolt method of displaying rolls of material such as fabric discussed above provides an aesthetically pleasing means of fabric display. First of all, because the same types of materials are commonly grouped together in order that the variety of colors in which they are available may be displayed, customers must wander up and down the aisles between the racks to search for materials which complement each other. Because the racks tend to be so space-consuming, as discussed above, this can represent a significant path of travel for the customer. In addition, the conventional material display arrangements fail to provide any guidance for the consumer as to which materials work well together from a design perspective.

A further problem with the typical fabric display methods and apparatus is the failure to provide an easy way for the customer to obtain a swatch of the fabric. Typically, when a customer sees a roll of fabric that the customer likes, either the customer or the store clerk cuts a piece from the roll or bolt. This results in an uneven cut edge on the roll of fabric. As a result, when a customer later wishes to purchase some of that fabric, the clerk is forced to trim the fabric to provide a straight edge in order to provide the customer with the full length of fabric to be purchased. This can result in a significant expense which must be borne by the store, particularly since some fabrics tend to be extremely expensive.

Thus, a need exists for an apparatus and method for displaying and dispensing material from rolls which provide good visibility of the material and easy dispensing of such, without requiring a large amount of store floor space. In addition, a need exists for an apparatus and method for displaying materials where coordinated materials can be displayed together so as to provide design guidance to the consumer and an aesthetically pleasing display of the materials.

OBJECTS AND SUMMARY OF THE INVENTION

It is therefore an object of the present invention to provide an apparatus and method for displaying a plurality of rolls of material while minimizing the amount of store space needed to display such materials.

It is also an object of the invention to provide an apparatus and method for displaying rolls of material wherein a large number of different materials may be viewed at one time.

It is a further object of the invention to provide an apparatus and method for dispensing rolls of material readily and easily without requiring removal of the rolls from the display apparatus.

It is another object of the invention to provide an apparatus and method for displaying rolls of material in a coordinated and aesthetically appealing arrangement.

These and other objects are accomplished by providing an apparatus in the form of a carrier or display rack having a plurality of carrier units, each of which includes a substantially rectangular frame which is pivotable about a vertical axis extending substantially along a vertically extending side thereof. The plurality of carrier units preferably are pivotably movable from a normal inward closed position wherein only a portion of each but one of the endmost carrier units is exposed to an outward open position wherein each carrier unit is fully exposed. Each of the carrier units includes a plurality of pairs of cooperating roll supports positioned along the vertical sides thereof. The roll supports are adapted to support a plurality of rolls of material so that each roll extends across the width of the carrier unit frame, and the rolls are vertically spaced apart from each other.

In a preferred embodiment of the invention, a lower carrier unit support is attached to the floor of a showroom, preferably spaced slightly from and extending parallel to a wall thereof. A cooperating upper carrier unit support is attached to a wall of the showroom and extends horizontally and outwardly therefrom, preferably in a common plane with the lower carrier unit support, in order to form a carrier for the carrier units. A plurality of the carrier units are then mounted to the upper and lower carrier unit supports so that each carrier unit is pivotable about a vertical axis extending substantially along one of its vertically extending sides, with the vertical axes of the individual carrier units being spaced from one another along the upper and lower carrier unit supports.

The substantially rectangular frame of each carrier unit preferably has a widthwise dimension defining the outward extent of the carrier unit from its pivotable mounting. The spacing between vertical axes of adjacent carrier units along the upper and lower carrier unit supports is preferably less than the widthwise dimension of the carrier unit frames. In this way, the carrier units overlap when they are positioned at an angle other than a 90° angle with the plane extending along the upper and lower carrier unit supports, i.e. the plane formed by their respective vertical axes of pivot. When the carrier units are positioned at such angles of other than 90°, only a portion of the rectangular face of each carrier unit is exposed due to the fact that the overlapping adjacent carrier unit covers the other rest of the overlapped carrier unit's rectangular face. Because the rolls of material extend across the frame width and are thus displayed across the rectangular face of the frame, only a portion of each of the rolls carried by the carrier unit is exposed. Further, the spacing between the pivotable mountings of each of the carrier units can be preselected in order to provide the optimal amount of exposure and overlap of each of the carrier units. Because of the ability of these carrier units to overlap, a particularly attractive arrangement of rolls of material can be made in a limited amount of space. In addition, the spaced pivotable mountings of the individual carrier units allow each carrier unit to be pivoted outwardly, similar to the turning of pages in a book, to thereby enable the entire width of the rolls carried thereon to be viewed and dispensed.

As an additional advantage, the display apparatus of the present invention includes a cutting device which can be removably mounted as the individual carrier unit frames. The cutting device includes a means for measuring a length of material as it is removed from any of the rolls carried by the carrier unit and cut, thereby obviating the need for the clerk to remove the rolls from the rack for cutting. Furthermore, this apparatus obviates the need for cutting tables in the store, thus saving valuable floor space.

The present invention also includes methods for displaying rolls of material and methods for dispensing rolls of material. A method of displaying rolls of material preferably includes providing a substantially rectangular frame pivotally mounted along one side thereof on a vertical axis and mounting in vertically spaced relation on the frame a plurality of horizontally extending rolls of material with the mounting being such as to permit unwinding of the material from the rolls.

A method for displaying rolls of material is also provided which preferably includes mounting a plurality of substantially rectangular frames such that each frame is pivotable about its own vertical axis of pivot which extends substantially along a vertical side of the frame, said axes being spaced apart from each other along a common horizontal plane and mounting on each frame a plurality of horizontally extending rolls of material.

Further, a method for displaying and/or dispensing rolls of material is provided which also preferably includes providing a substantially rectangular frame having rolls of material horizontally mounted thereon, providing a measuring device mounted to the frame and positioned to receive the material from the rolls, and feeding material from a roll to the measuring device for measurement thereof. This method preferably also includes measuring the material as the material is fed to the measuring device and winding the material onto a roll as the material is being measured.

BRIEF DESCRIPTION OF THE DRAWINGS

Some of the features and advantages of the present invention having been stated, others will become apparent as the description proceeds when taken in conjunction with the accompanying drawings, in which:

FIG. 7 is a perspective view of a carrier unit of the display apparatus according to the invention and showing one form of upper and lower carrier unit supports;

FIG. 8 is a perspective view of the portion of the carrier unit of FIG. 7 showing how the frame pieces can be assembled together;

FIG. 9 is a front view and partial cross section of a rod as shown in FIG. 7 as it is supported on the frame of the carrier unit;

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the illustrated embodiments set forth herein; rather, these illustrated embodiments are provided so that this disclosure will be thorough and complete and will fully convey the scope of the invention to those skilled in the art. Like numbers refer to like elements throughout, and prime numbers represent a modified embodiment of a previously designated element.

Figure 1:
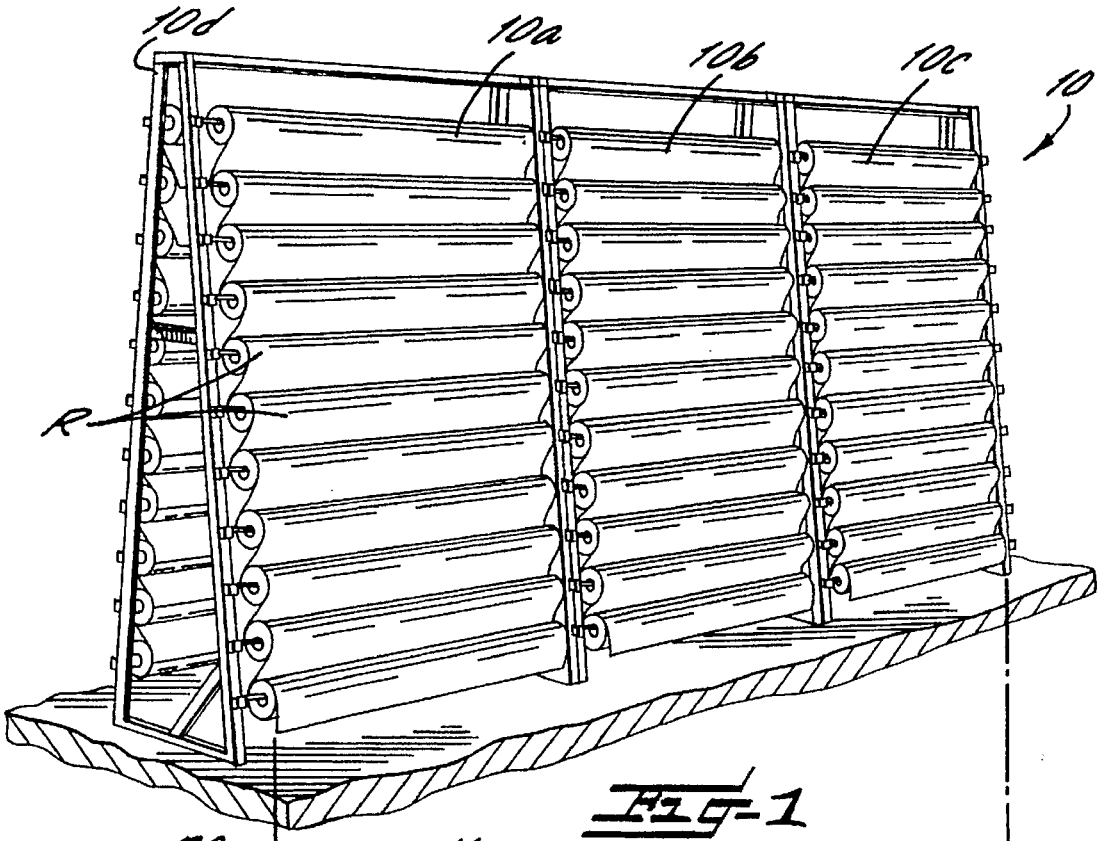
FIG-1 PRIOR ART
FIG. 1 depicts a prior art A-frame type of rack for displaying rolls of material.
Figure 2:
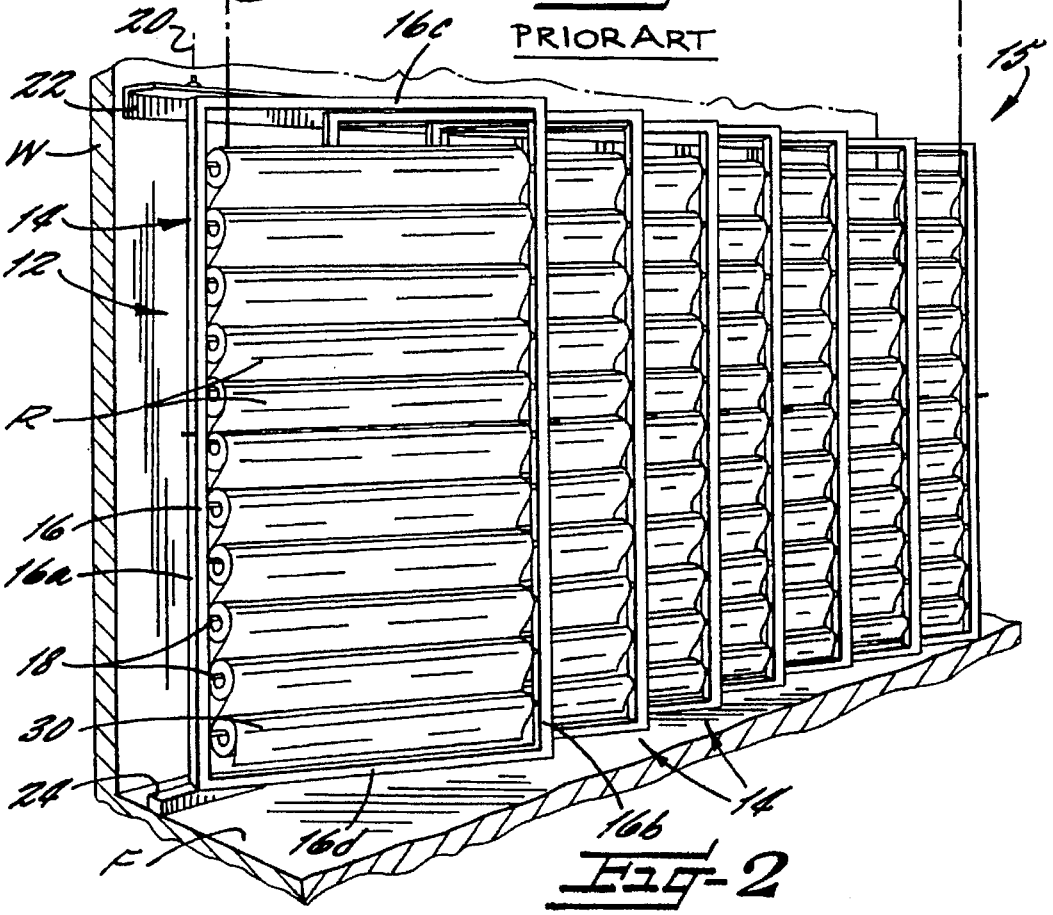
FIG. 2 is a perspective view of a display apparatus according to the present invention with all of the carrier units being in their closed overlapping position.

FIG. 1 illustrates a prior art A-frame-type apparatus 10 for rolled materials with pluralality rolls of material being supported one above the other in racks 10*a*, 10*b*, 10*c* and 10*d*. As shown, the rolls may be rolls of fabric R supported on front and back sides of the display apparatus 10. Each rack, however, requires floor space equivalent to at least the width of the rolls to be supported. Because the rolls must be removed for the material thereon to be cut, the rack height is undesirably limited to a height easily reachable by the store employees. In addition, when rolls of material are to be provided on the front and back sides of the display apparatus 10, walkways need to be provided on both sides of the apparatus. Therefore, this apparatus 10 requires a large amount of showroom floor space to display only a minimal number of rolls of material. Further, and as discussed above, this type of display apparatus 10 necessitates the provision of separate cutting tables to which the rolls of material may be removed for cutting. This requirement for the provision of cutting tables also represents an additional demand on showroom floor space.

FIGS. 2–6 illustrate a display apparatus 15 according to the present invention. The display apparatus 15 includes a carrier 12 which preferably includes a plurality of carrier units 14 and means for supporting the carrier units in the desired position. Each carrier unit 14 includes a frame 16 which is preferably substantially rectangular so as to include two vertically extending sides 16*a* and 16*b* and upper and lower horizontally extending sides 16*c* and 16*d*.

Each frame 16 is mounted so as to be pivotable about a vertical axis 20 which extends substantially along one of its vertically extending sides 16*a*. In a preferred embodiment of the invention, the frames 16 are pivotably mounted by way of a carrier support preferably having upper and lower carrier unit supports 22 and 24, respectively thereof. The upper carrier unit support 22 is desirably attached to a wall W of the showroom so as to extend horizontally along the wall W and outwardly therefrom. The lower carrier unit 24 is desirably attached to extend horizontally along the floor F. It is noted, however, that these carrier unit supports 22, 24 could be attached along any means of support, for example, the lower carrier unit could extend from the wall W and/or the upper carrier unit 22 could extend from the ceiling of the showroom. The carrier unit supports 22, 24 are preferably located within a common plane, with the carrier units 14 being spaced therealong so that the individual carrier units 14 can pivot or swing through at least about a 30° angle, and preferably approaching a 180° angle, as will be discussed further herein.

The carrier unit frames 16 of the carrier 12 include a defined face 30 which is the area which is surrounded by the frame 16, and the frames 16 define a widthwise extent which is desirably similar to the length of the rolls, such as rolls of fabric, wallpaper, tile, carpets, or other sheet material, to be carried thereon. The widthwise extent of the frame 16 is desirably greater than the distance between the pivotable mountings of adjacent carrier units 14. As a result, when adjacent carrier units 14 are pivoted in the same or a similar direction, individual carrier units overlap their respective adjacent carrier units 14, which are in the direction of pivot. Similarly, when adjacent carrier units 14 are pivoted in the opposite direction, the previously overlapped carrier unit overlaps the carrier unit 14 which was previously the overlapping carrier unit 14.

The frames 16 include cooperating pairs of roll supports along vertically extending sides 16*a* and 16*b*. The roll supports 18 which are provided on the frame 16 are adapted to support a plurality of rolls of material 32 to display and maintain them within the face 30 defined by the frame 16. The roll supports 18 are adapted to support the rolls 28 so that they extend horizontally across the frame and the rolls are vertically spaced one above another. As previously discussed, when adjacent carrier unit frames 16 are pivoted in the same or a similar direction, carrier units 14 overlap their respective adjacent carrier units in the direction of pivot to cover a portion of the face 30 thereof. When the carrier units 14 include rolls of material 28 mounted thereon, the result is that only an end portion of each of the rolls is exposed. This results in a display which allows for the viewing of many different materials at once.

This feature has the advantage of enabling the selective arrangement of a large number of rolls of material 20 to form a particularly coordinated and aesthetically pleasing array of materials. For example, when the display apparatus is to be used for the display and dispensing of fabrics for home furnishings, an interior designer can preselect and arrange the fabric rolls along the apparatus so that each carrier unit 14 features rolls of fabrics which all coordinate with each other, i.e., by color, pattern, textures, and the like. As a result, a consumer can view the entire display, then move to the portion thereof which carries a color in which he or she is interested. In order to get full exposure of the rolls in which he or she is interested, the customer needs only to pivot the carrier unit 14 containing those rolls of material 28 in which he or she is interested in a direction opposite that of its overlapping adjacent unit to obtain full exposure thereof in the manner shown in FIG. 4. Because the fabrics have been pre-coordinated by the designer and displayed together, the consumer is no longer forced to look through all of the fabrics in the store in search of colors, patterns and textures which can be used together in an aesthetically pleasing manner. Although discussed most particularly with reference to fabrics, it is noted that the apparatus of the instant invention can be used with any sheet-like materials which can be provided in roll form, including but not limited to carpet, wallpaper, paper, cloth, and linoleum, for example.

Figure 3:
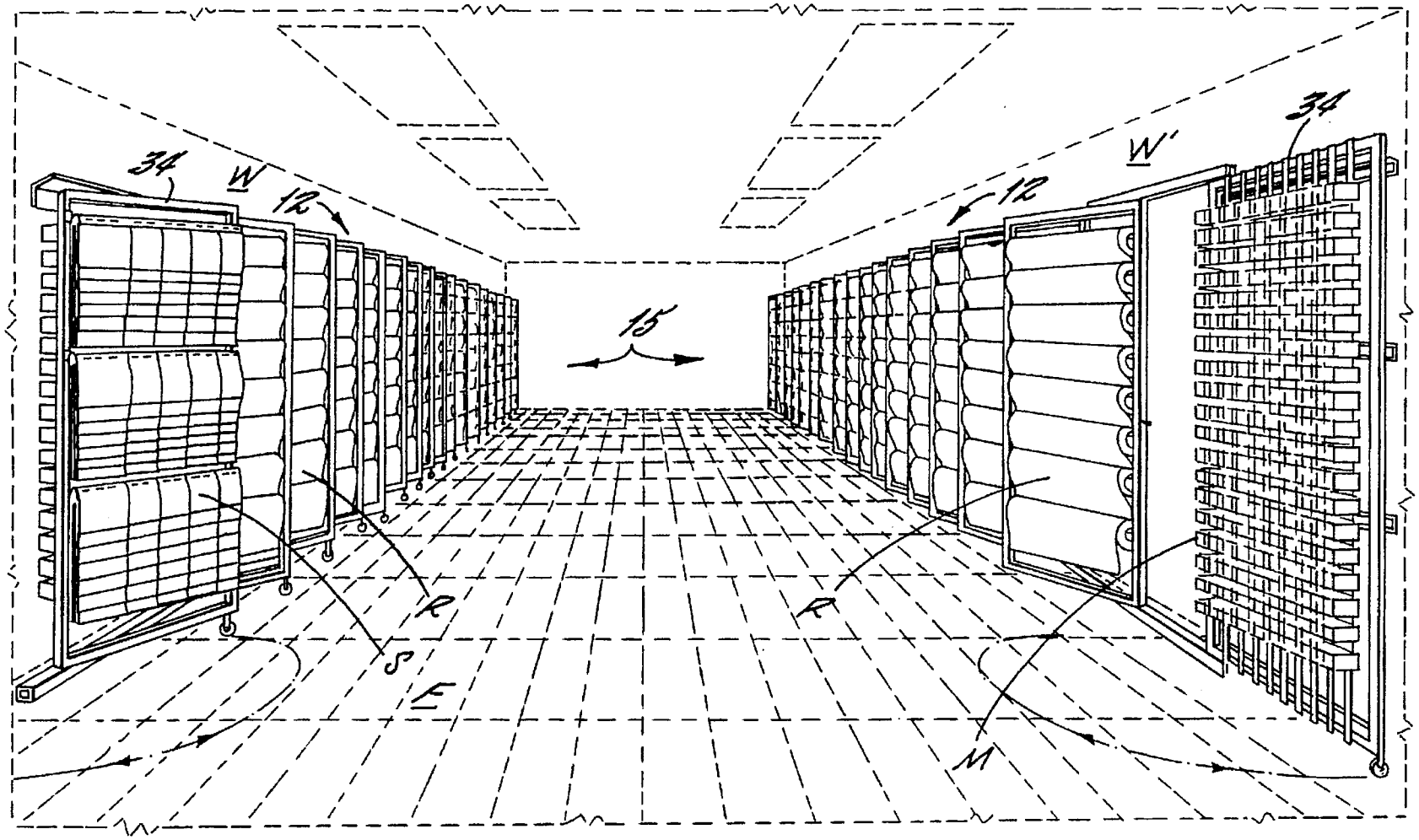
FIG. 3 is an environmental view of left and right hand versions of the display apparatus according to the present invention shown mounted on opposing walls of a showroom and showing carrier units on both of the display apparatus which have large swatch samples on one side thereof and small swatches on the opposite side thereof.

As shown in FIG. 3, carriers 12 may be arranged along opposing walls W, W' of a showroom, in order that consumers can get an initial viewing of all the available materials immediately upon entering the store. Depending on the store dimensions, this may require the use of several or many carriers 12, which can be made to be modular in order that a store can configure the display apparatus 15 to suit the structure of its particular showroom. In a preferred form of the invention as shown in FIG. 3, one of the carrier units has been modified to form a swatch unit 34 to accommodate smaller material samples rather than complete rolls of material. In a preferred form, this swatch unit 34 includes on one face means for displaying and supporting large swatch units S of the materials which are included on the remainder of the carrier, such as those shown in FIGS. 21–27 and described further herein. The other face of the swatch unit 34 desirably includes means for supporting small swatches M of material, i.e., memos of fabric or other material, which may be taken with the consumer, as will be discussed further herein with respect to FIGS. 28–30. This swatch unit 34 can be used to form a table of contents or directory of the carrier for use by the customer, store, clerks, or other personnel by including smaller pieces of the various materials and an indication on the smaller pieces of the position on the carrier 12 where the full roll R of material can be located. Furthermore, by providing smaller samples which can be easily removed from the apparatus, a consumer can carry the smaller pieces around to compare with other goods or material rolls which are remote from that of the sample. These swatches may be in the same order as the rolls of material and thus form a guide for the rolls contained on the other carrier units. Alternatively this swatch unit could be used to display the samples in a different order in order to show a variety of ways in which the various fabrics or materials displayed can be coordinated. Alternatively, the swatches could be arranged alphabetically by manufacturer, for example.

The carrier units are each pivotable about their mountings and thus each can be pivoted from one side to another to allow full viewing of its face 30 and adjacent carrier units. As noted above, however, the individual carrier units are desirably spaced so that a portion of the defined face 30 of each of the carrier units 14 is readily visible when the carrier units are positioned in their inward closed position, despite the overlapping of an adjacent carrier. This enables a consumer to initially determine which carrier unit 14 contains fabric in which he or she may be interested while viewing the display apparatus as a whole. The consumer can then pivot adjacent carrier units away from the one containing the selected material in order that full viewing can be had of the carrier unit containing the materials which he or she desires to view more closely. These materials can then be readily unrolled by a customer or clerk for viewing of a large piece thereof and for cutting a desired length of the material in the manner illustrated in FIGS. 4 and 6. Alternatively, the customer can begin with the swatch unit 34 and select materials therefrom, then determine the location of the complete fabric rolls and proceed to the roll for further inspection and/or cutting of the material.

Figure 4:
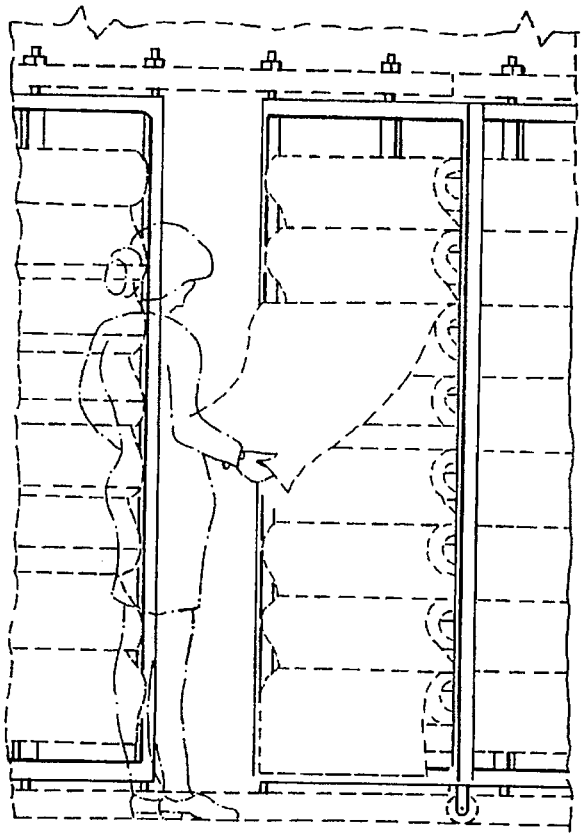
FIG. 4 is a perspective view of the right hand unit as shown in FIG. 6 as it appears during use.
Figure 35:
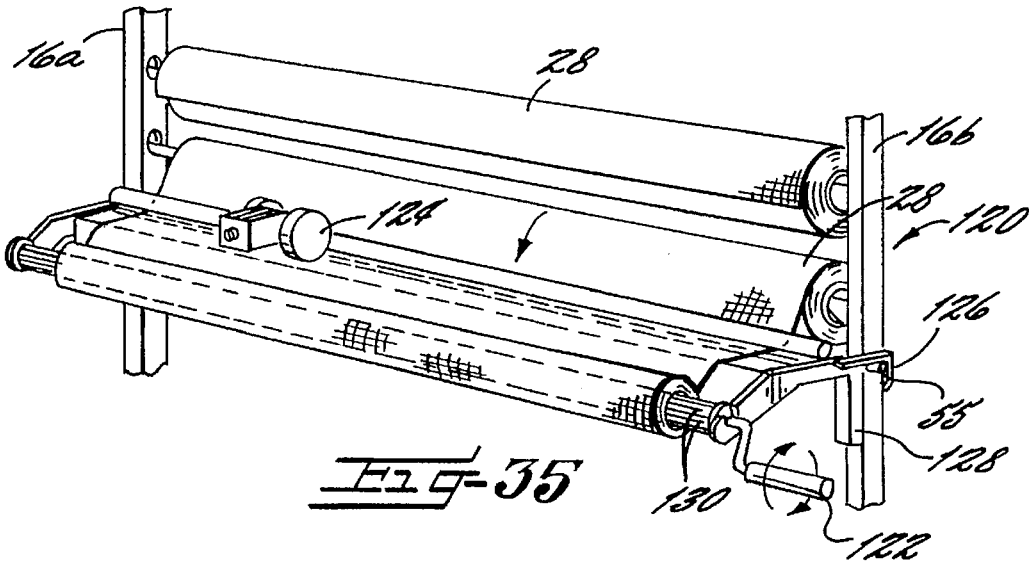
FIG. 35 is a perspective view of a cutting device as it appears attached to a carrier unit frame.
Figure 36:
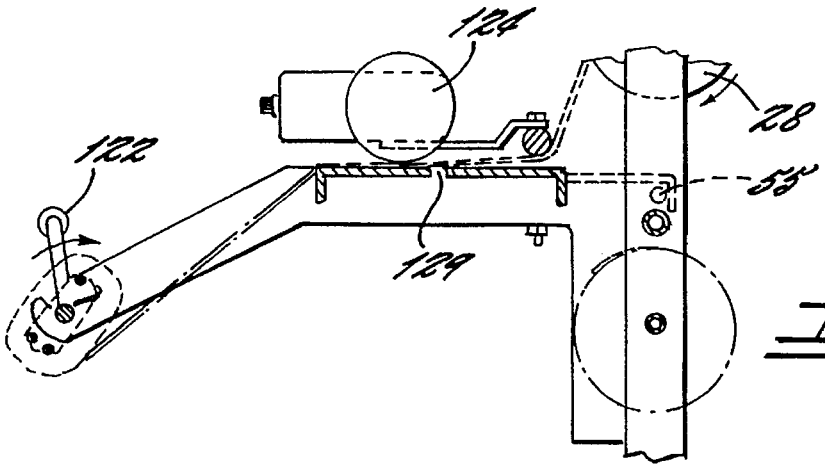
FIG. 36 is a cross sectional view of the cutting device as it appears attached to a carrier unit frame as shown in FIG. 35.

To cut material from one of the rolls 28, a person unrolls it in the manner shown in FIG. 4, then feeds it into a cutting device such as that shown in FIGS. 35 and 36. The cutting device 120 includes a pair of hooked arm portions 126 which hook around pins 55 which extend outwardly from the vertical frame elements 16*a* and 16*b*. Cooperating leg portions 128 bear against the front of frame 16 and cooperate therewith to support the cutting device 120 in an outwardly extending position. The cutting device 120 desirably includes a measuring device 124, which measures the length of material fed through the cutting device. The cutting device 120 includes a plurality of spaced elongate bars 130, which extend substantially the width of the frame, and a handle 122, with one of the bars 130*a* being pivotable toward another of the bars 130*b*, which is stationary within the cutting device, in response to a turning motion of the handle. Therefore, once the material is fed into the space between the pivotable bar 130*a* and a stationary bar 130*b*, the handle 122 is turned, thereby causing the pivotable bar to move toward the stationary bar and capture the material end therebetween. As the person continues to turn the handle 122, the material is wound into roll form. When the measuring device indicates that the desired amount of material has been wound, the person guides a bladed implement such as a pair of scissors through opening 129 in the cutting device, thereby providing a straight cut edge on the material. Because the cutting device 120 mounts readily on the frame 16, the material can be cut while it is still on the roll which is still secured to the frame. Material from any of the rolls on the frame can be readily measured and cut without requiring the lifting or removal of the rolls and the need for cutting tables is thus eliminated.

Figure 5:
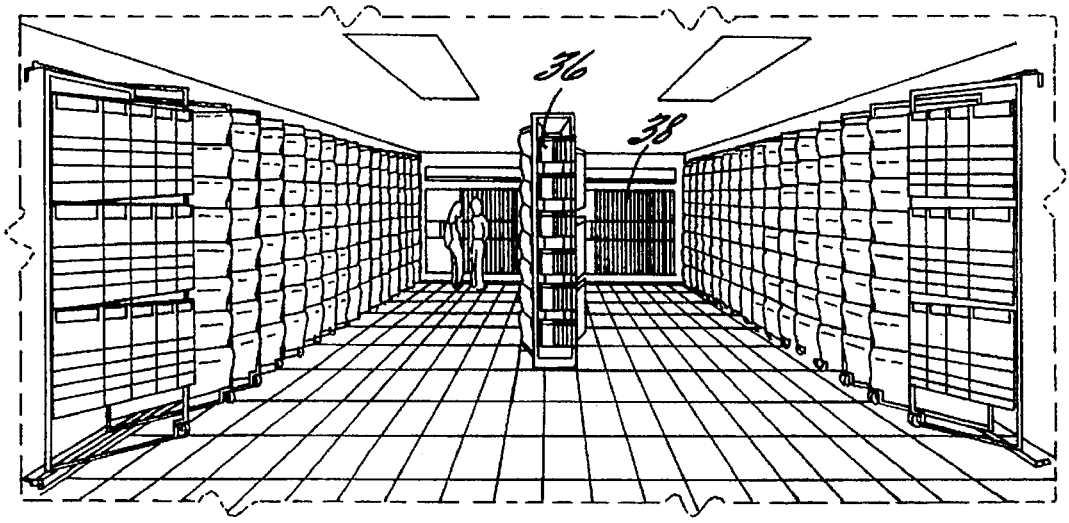
FIG. 5 is an environmental view of right and left hand versions of the display apparatus according to the present invention mounted on opposing walls of a showroom and a free standing display apparatus also according to the present invention located therebetween and showing material samples mounted along the showroom rear wall.
Figure 6:
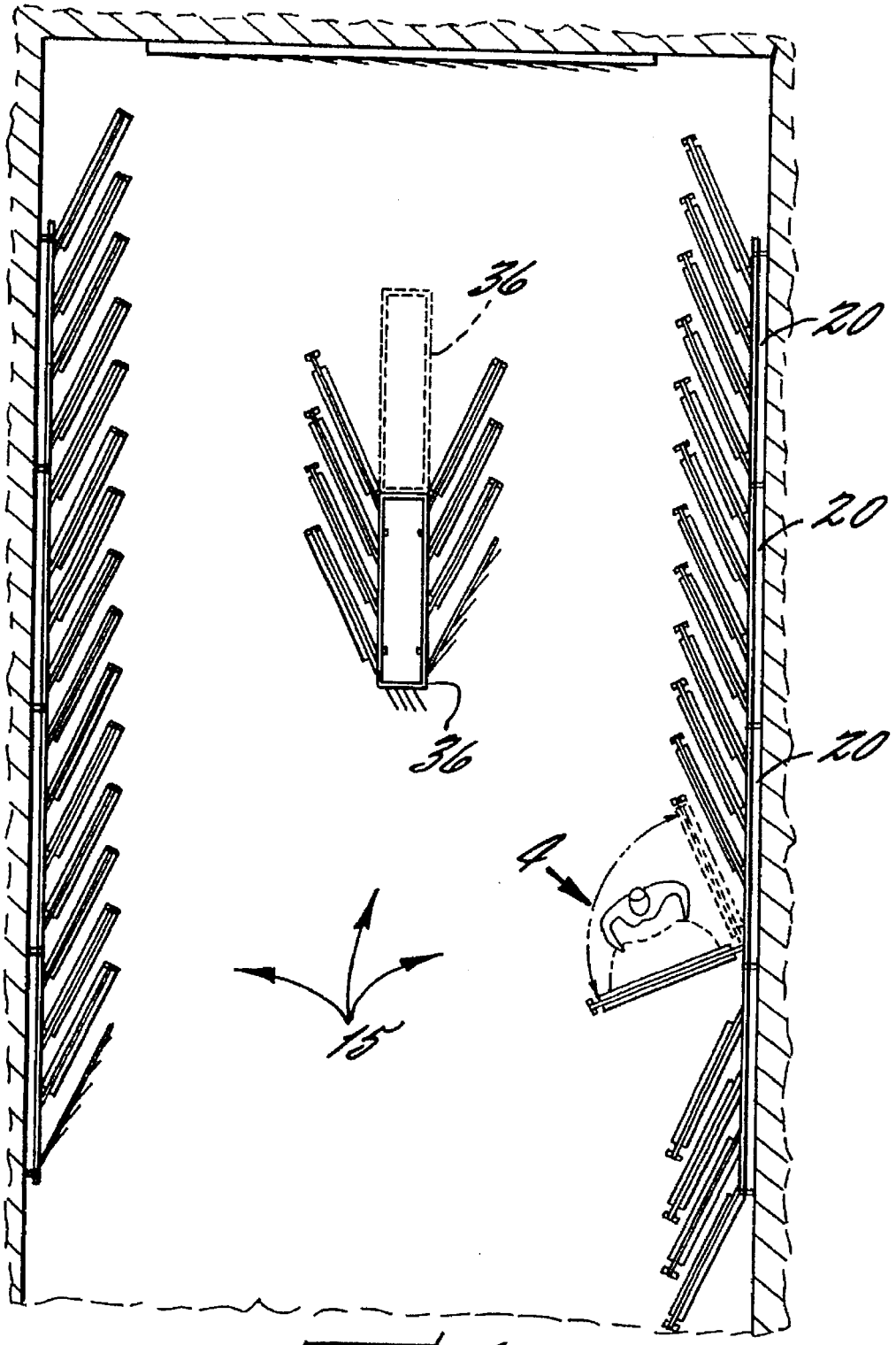
FIG. 6 is a plan view of right and left hand versions of the display apparatus according to the invention as they appear with the right hand unit during use as shown in FIG. 4 and with a freestanding unit according to the invention located between the right and left hand apparatus.

Typical organizations of display apparatus of the present invention as they could be arranged in a store are shown in FIGS. 3, 5, and 6. In this particular example, left and right hand versions of wall mounted display apparatus are displayed in opposing relationship along opposite walls W, W' of the store. In addition, a free standing display carrier 36 of the present invention is shown as it is centered between the right and left hand wall mounted units. In addition, a supplemental swatch display 38 is shown along the back wall of the store. As the figure illustrates, this arrangement makes a tremendous visual impact due to the orderly way in which the carrier units 14 carrying the rolls of material 32 cascade along the walls and direct the consumer's eye into and toward the rear of the store. This is of particular advantage because stores must often go to great lengths to draw the customer's attention onto the store, and the display apparatus inherently performs this function.

AS shown from the overhead view of the display apparatus in FIG. 6, the freestanding carrier 36 as well as the wall mounted carriers can be supplied in modular form, as indicated by the dotted lines. This enables the display apparatus to be shipped in smaller pieces, as discussed further herein, and for the apparatus to be readily structured to accommodate individual store configurations as well as particular goods to be displayed.

FIGS. 7, 8, 13, and 14 depict preferred constructions of a carrier 12 according to the present invention. The vertically extending frame elements 16*a*', 16*b*, and 16*a*", 16*b*" and the horizontally extending frame elements 16*c*', 16*d*', 16*c*", and 16*d*" are assembled together to form substantially rectangular frames in the manner shown in FIGS. 8 and 14. In a preferred construction of this invention the frame elements are constructed so as to matingly fit together. For example, the horizontal elements 16*c*' and 16*d*' can have reduced diameter end portions which are received within the ends of the vertically extending frame elements 16*a*' and 16*b*, which are bent at right angles to receive elements 16*c*' and 16*d*'. These frame elements can then be secured together by way of a nut and bolt combination as shown at 38 and 40 respectively. These elements, however, could be secured together through other conventional means such as crimping, gluing or soldering, as would be appreciated by one skilled in the art.

Figures 13, 14:
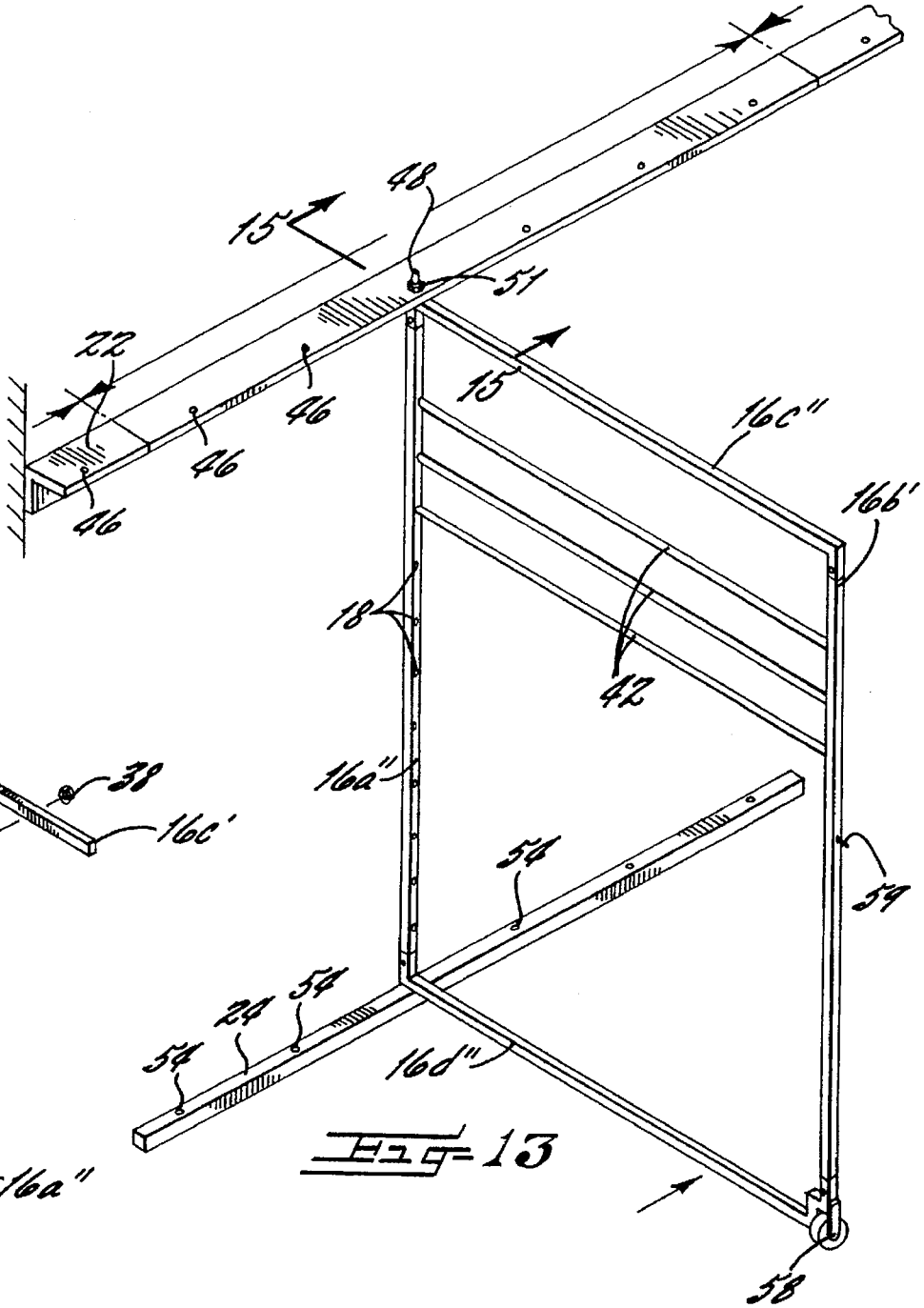
FIG. 13 is a perspective view of an alternative embodiment of the carrier unit depicted in FIG. 7 showing an alternative upper carrier unit support and frame construction.
FIG. 14 is a perspective view showing how the frame of FIG. 13 can be assembled.
Figure 18:
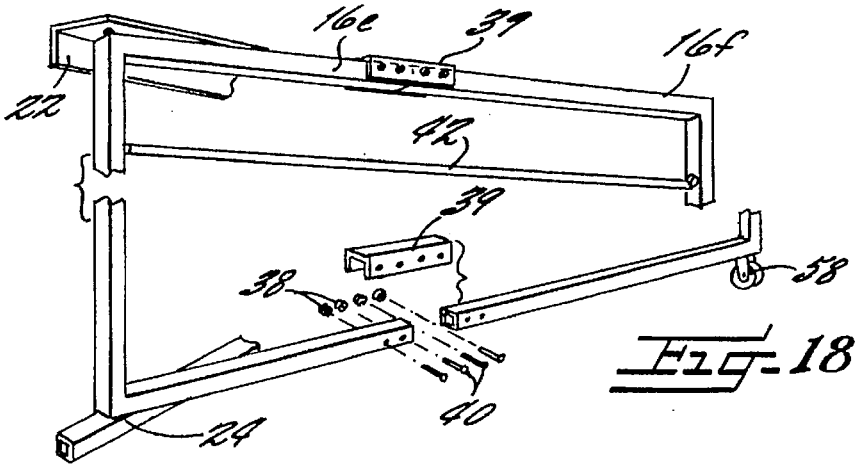
FIG. 18 is a view of an alternative construction of a carrier unit frame according to the present invention.

Alternatively, frame elements 16*c*" and 16*d*" could be bent at right angles to receive reduced diameter end portions of frame elements 16*a* and 16*b*, as shown in the embodiment of FIGS. 13 and 14. As a further alternative, two frame elements 16*e* and 16*f*, each of which is shaped to form half of a rectangle, can be joined by brackets 39 which can be attached thereto by nuts and bolts 38 and 40, as illustrated in FIG. 18. By providing the frame as a plurality of pieces which can be easily assembled together, the display apparatus can be supplied in kit form, and the apparatus can be custom configured to accommodate the particular location where it is to be used and the particular goods it will be used to display.

The vertically extending frame elements 16*a* and 16*b* are preferably provided with roll supports 18. The roll supports 18 are adapted to receive and support rolls of material 28.

In a preferred embodiment of the invention, the carrier unit 14 is provided with a plurality of rods 42 which are adapted to be supported by the roll supports 18. In a particular preferred embodiment of the invention, the roll supports 18 comprise openings in the vertically extending frame elements 16*a* and 16*b*. As shown in FIG. 9, the rods 42 can have shoulders 41 spaced inwardly slightly from each of the respective, rod end portions. In addition, the rods 42 can include bulbs 43 on the respective rod ends, to assist in maintaining the rods within the roll supports 18, particularly when the roll supports are in the form of openings in the frame 16. In this way, a first end of the rod 42 can be placed in a roll support 18 such as the openings along the vertically extending frame elements 16*a* and 16*b*. In this embodiment the frame elements 16*a* and 16*b* have sufficient internal space so that when one end portion of the rod 42 is inserted into a first opening and pushed inwardly therein, the rod can then be pivoted and the other end placed in the corresponding opening of the other vertically extending frame element to thereby secure the rod in a horizontal position within the carrier unit frame 16. The shoulders 41 of the rod 42 can be provided as separate shaped end portions 44 which are inserted within a hollow rod 42. Rod 42 is then crimped to secure the shaped end portions 44 therein, thereby forming a rod structure with shouldered end portions. Alternatively, the shaped portions could also be made integrally with the rod itself, such as by molding or crimping the rod. In addition, it is noted that the roll supports 18 of the present invention are not limited to the shaped rod and opening combination discussed above, but could be other combination rod and support means such as U-shaped members (not shown) as would be recognized by one having ordinary skill in the art. Further, the roll supports 18 could be adapted to support the rolls of material directly or the cardboard tubes on which many rolled materials are conventionally provided, though the use of a rod is particularly preferred because it enables the material contained on the rolls to be dispensed with particular ease.

Figure 11:
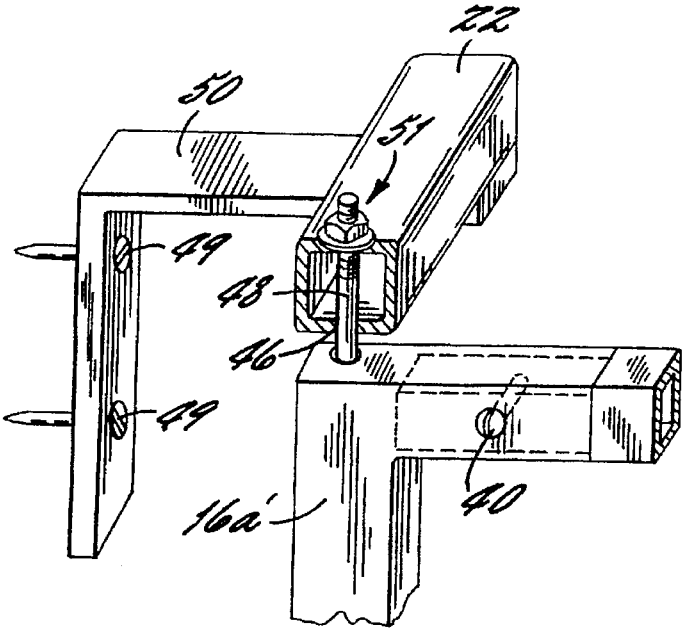
FIG. 11 is a perspective view and partial cross sectional view of the upper carrier unit support and an upper portion of the carrier unit shown in FIG. 7.
Figure 12:
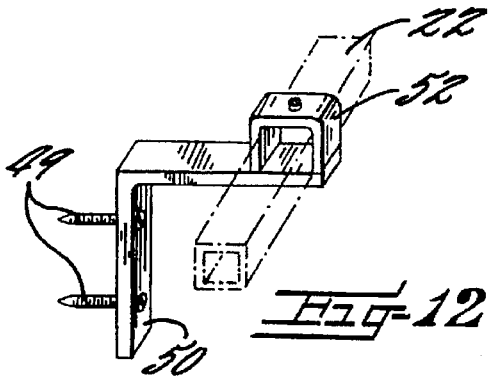
FIG. 12 is a perspective view of an alternative embodiment of an upper carrier unit support.

In order to secure the carrier units 14 to the wall and floor, upper and lower carrier unit supports 22 and 24 can be provided. The arrangement and configuration of the carrier 12 and the mounting of the carrier units 14 was developed for structural support and strength to reduce the possibility of damage to a supporting wall and/or floor during use over an extensive time period. Upper carrier unit 22 is preferably provided in the form of a hollow bar which includes a plurality of spaced openings 46 therein. The frame includes a rod 48 which extends upwardly from the vertically extending frame element 16*a*. This rod is threadingly received by one the openings 46 in the upper carrier unit support 22 to support the upper end of the carrier unit 14. The upper carrier unit support 22 can be fixed to the wall W, preferably in spaced relationship therefrom, by a plurality of brackets 50. The brackets can be secured to the carrier unit support 22 and the wall, as shown for example in FIGS. 7 and 11, by nails or screws 49, adhesive, welding or the like. Alternatively, the brackets 50 can have loops 52 formed about an upper surface in the manner shown in FIG. 7, with carrier unit support 22 being threaded through this loop 52.

Figure 15:
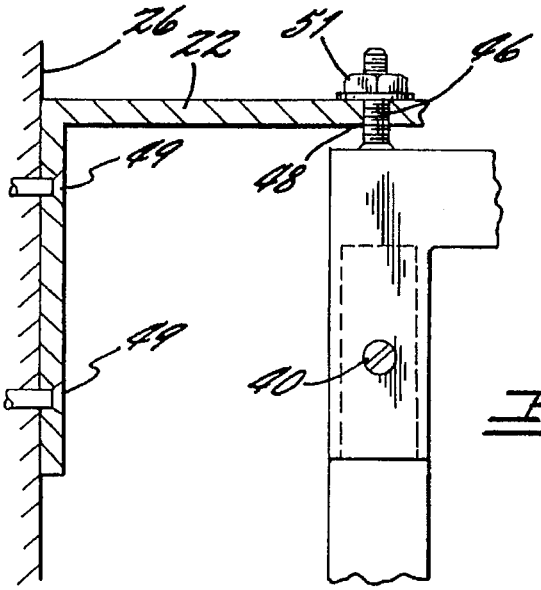
FIG. 15 is a cross sectional view of FIG. 13 as shown along lines 15–15.

In an alternative embodiment of the invention, the upper carrier unit support 22 is formed as one continuous unit having an L-shaped cross section throughout, as shown for example in FIGS. 13 and 15. In this embodiment of the invention, the need for separate brackets is dispensed with, and upper carrier unit support 22 itself can be attached directly to the carrier unit frame 14 and the wall 26. Spaced openings are desirably provided along the upper carrier unit support 22 in order that it may be secured to the wall 26 by nails or screws 49 or the like. In the embodiments shown in FIGS. 7, 11, 12, 13 and 15, a rod 48 extending upwardly from the carrier unit 14 may be threadingly received in one of the openings 46 and secured thereto by threading the rod into a nut and washer combination 51.

Figure 10:
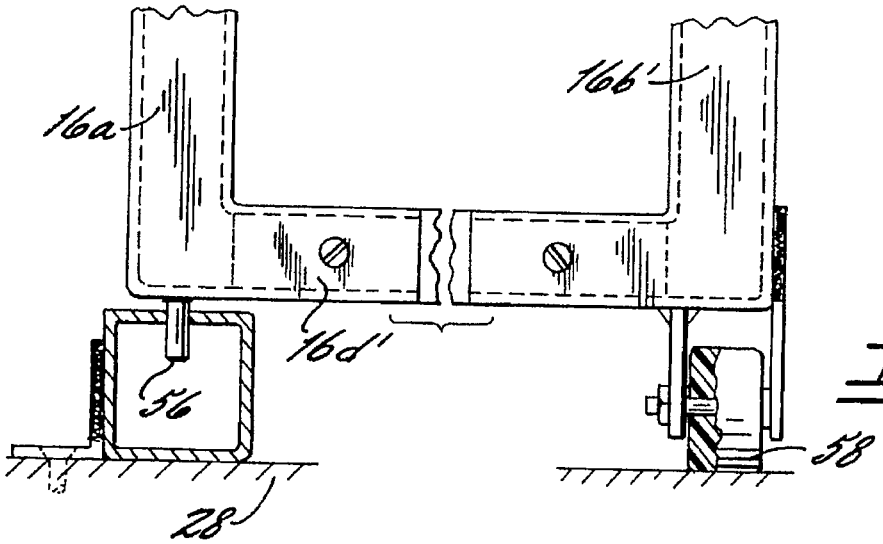
FIG. 10 is a front elevation and partial cross sectional view of a lower portion of the carrier unit and lower carrier unit support as shown in FIG. 7.
Figure 16:
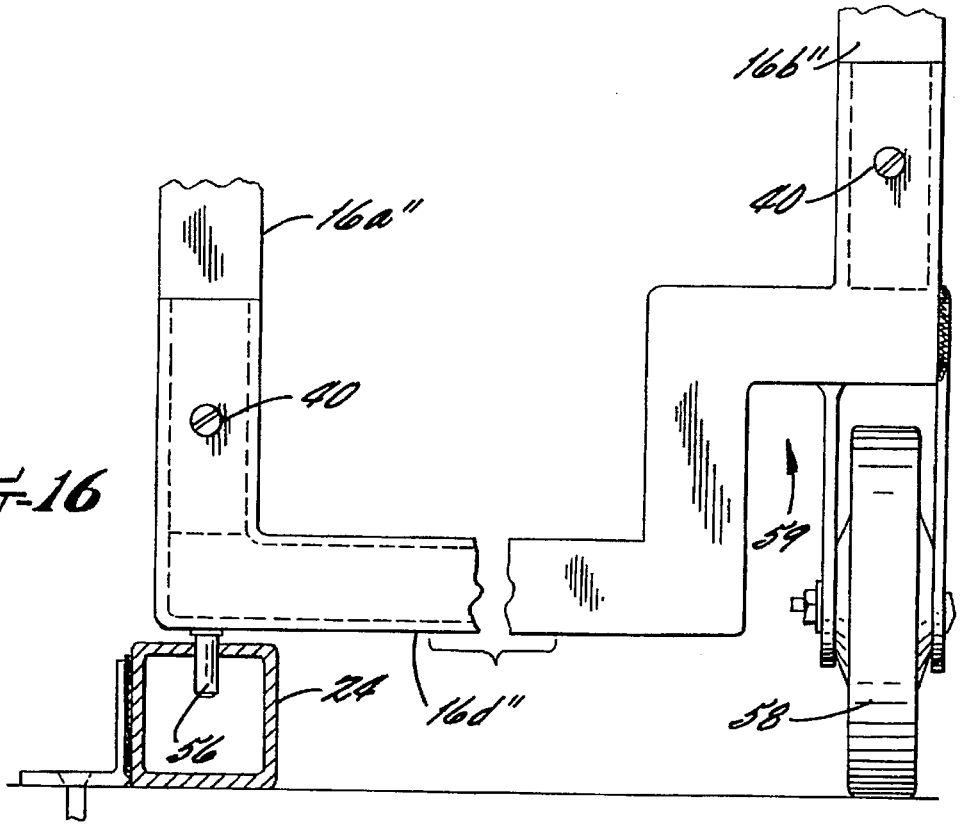
FIG. 16 is a partial cross sectional view of the lower carrier unit support and carrier unit of FIG. 13.
Figure 17:
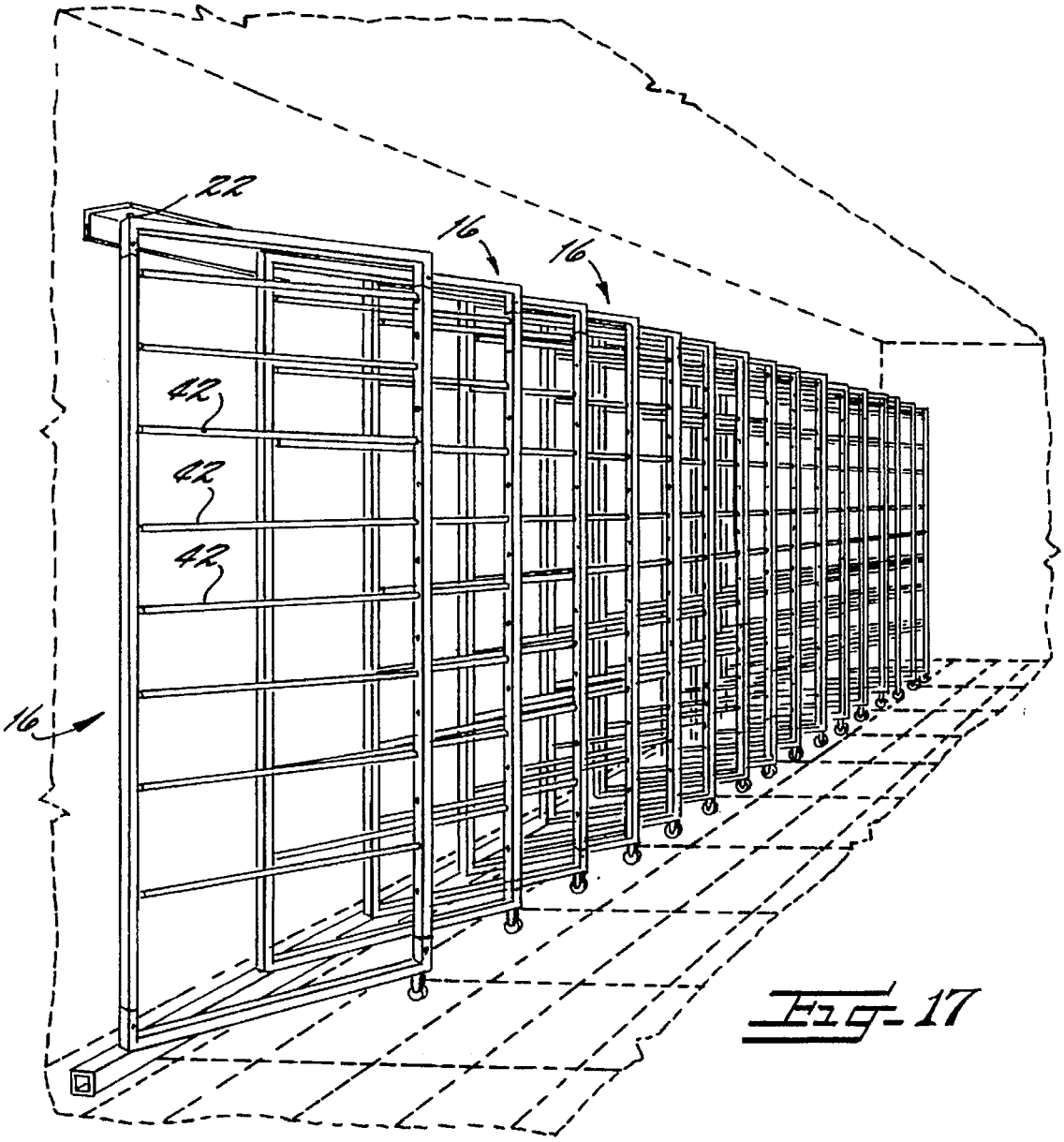
FIG. 17 is a perspective view of a left hand version of a display apparatus according to the invention as shown mounted along the wall of a showroom.

Lower carrier unit support 24 is desirably provided in the form of a track extending along the floor 28. The track desirably includes openings 54 therein which are spaced apart from each other. The track is desirably provided in the form of a hollow tube. The lower carrier unit support 24 is attached to the floor in the same manner discussed above with respect to the upper carrier unit support. Carrier unit 14 is desirably provided with a rod 56 which extends downwardly from the carrier unit along the axis of pivot thereof in the manner as shown in FIGS. 10 and 16. The rod 56 is sized to be received in the openings 54 within the lower carrier unit support 24. The openings 46 and 54 on the upper and lower carrier units 22 and 24 respectively are preferably spaced apart the same distance. When these units are mounted to the wall and floor, they are preferably attached such that the openings 46 and 54 are in substantial alignment, to form cooperating opening pairs. In this way, a frame 16 having rod elements 48 and 56 inserted in the openings 46 and 54 respectively is supported such that the frame extends vertically and is pivotable about a vertical axis 20 which extends substantially along a vertically extending side thereof.

In order to further support the frame 16, the carrier unit 14 is also desirably provided with a wheel 58. Wheel 58 is preferably positioned so as to be located underneath and proximate the opposite vertically extending frame element from that which is pivotally mounted. The wheel is sized to cooperate with lower carrier unit 24 to maintain the frame 16 so that it extends horizontally in a level manner.

In a preferred embodiment of the invention shown in FIG. 16, a portion of the corner of the substantially rectangular frame 16 is indented and a wheel 58 is placed within the indentation 59. In this way, a larger wheel can be utilized, which we have found better supports the weight of the frame 16 when the rolls of material 28 are placed thereon and enables the carrier unit to be pivoted more easily. However, as one having ordinary skill in the art would readily appreciate, the lower carrier unit support 24 could be made larger in order that the bottom frame element **16*d* is spaced at a greater distance from the floor, thus enabling the use of a large wheel without necessitating the provision of an indentation 59 in the frame 16**.

Figure 32:
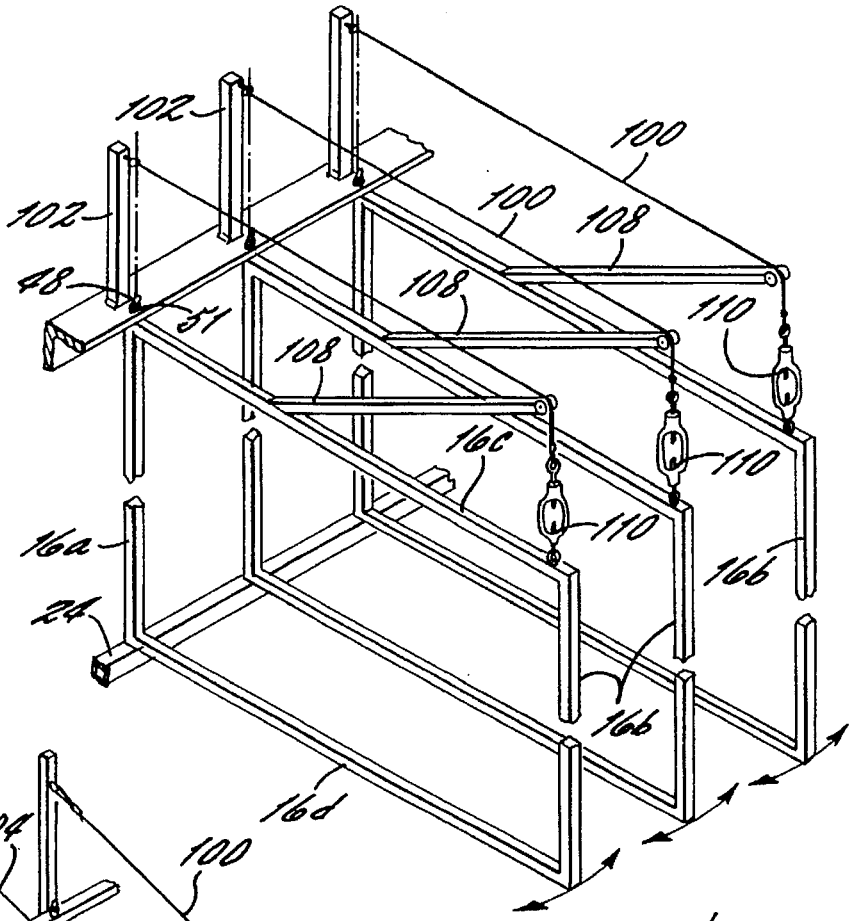
FIG. 32 is a perspective view of another alternative embodiment of the carrier unit support which utilizes a suspension system for supporting the carrier unit frames.
Figure 31:
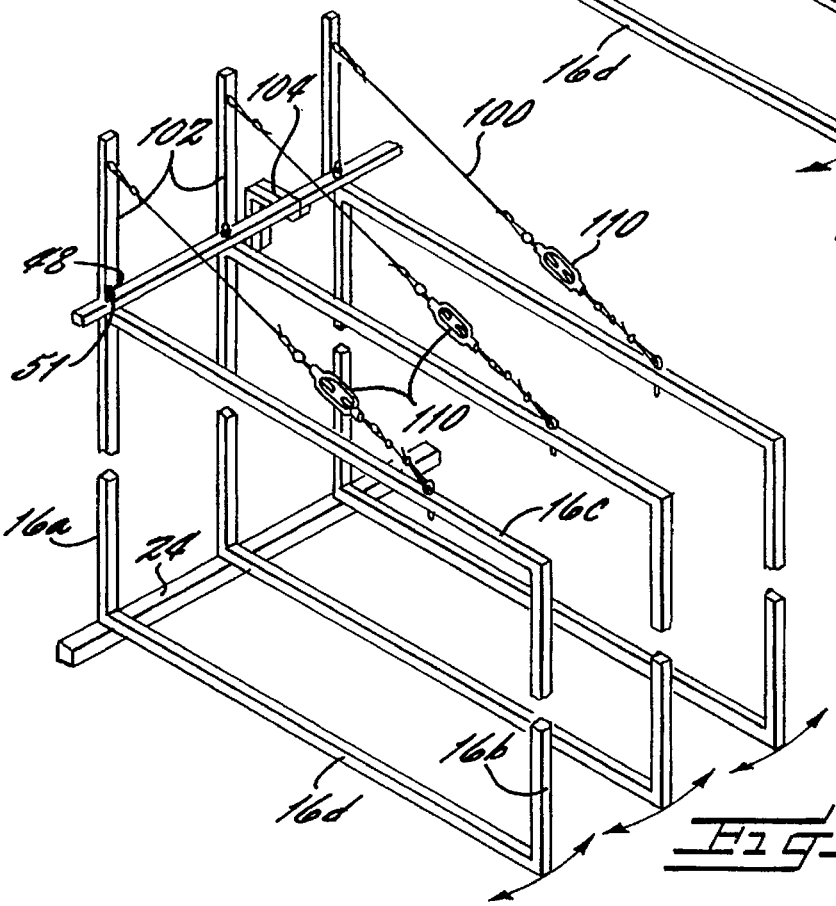
FIG. 31 is a perspective view of an alternative embodiment of the carrier unit support which utilizes a suspension system.

It is noted that means other than a wheel can be used to support the weight of the outward extent of the frames in order to relieve some of the stress from the upper carrier unit support 22, such as casters (not shown) and the like. For example, suspension systems such as those shown in FIGS. 31 and 32 which utilize a series of guidewires 100 to support the outwardly extending frame end can be used. In the suspension systems illustrated, each carrier unit 14 has a guidewire 100 assigned thereto. Each of the guidewires 100 has a first of its ends attached to a support located above the carrier unit 14, and preferably in line with the pivotable mounting of the respective frame 16. The guidewire end could be attached directly to a wall W or to support poles which are attached to and supported by upper carrier unit supports 22 and 22', which correspond to those illustrated in FIGS. 7 and 13. Opposite ends of the guidewires 100 are secured to the upper horizontally extending frame element **16*c* in any conventional manner so that the second guidewire ends are spaced outwardly from the first ends. For example, the second end may be secured to the frame 16 about the upper outward corner thereof (as shown in FIG. 32) or spaced somewhat inwardly of the upper outward corner (as shown in FIG. 31). Further, the wire may extend in a straight line path (as shown in FIG. 31), or may extend around a pivot bar 108 (as shown in FIG. 32) which extends outwardly from the frame upper horizontal side 16*c* to a position substantially above the upper outward frame corner. Additionally, connectors 110** may be provided adjacent the wire ends in order to allow for adjustability of the guidewire length.

Figure 19:
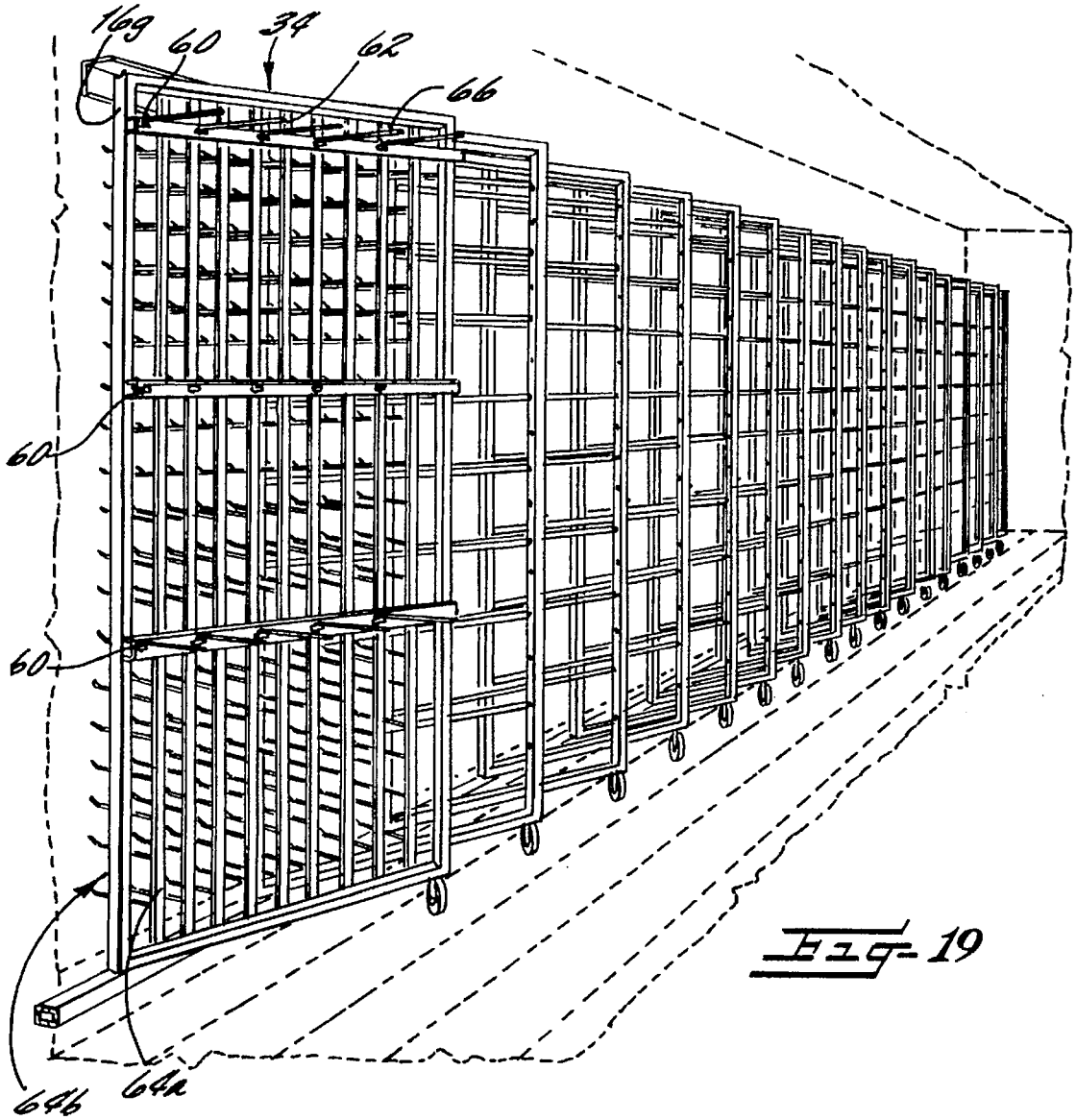
FIG. 19 is a perspective view of a display apparatus according to the present invention having an end most carrier unit which is adapted to hold swatches of material.
Figure 20:
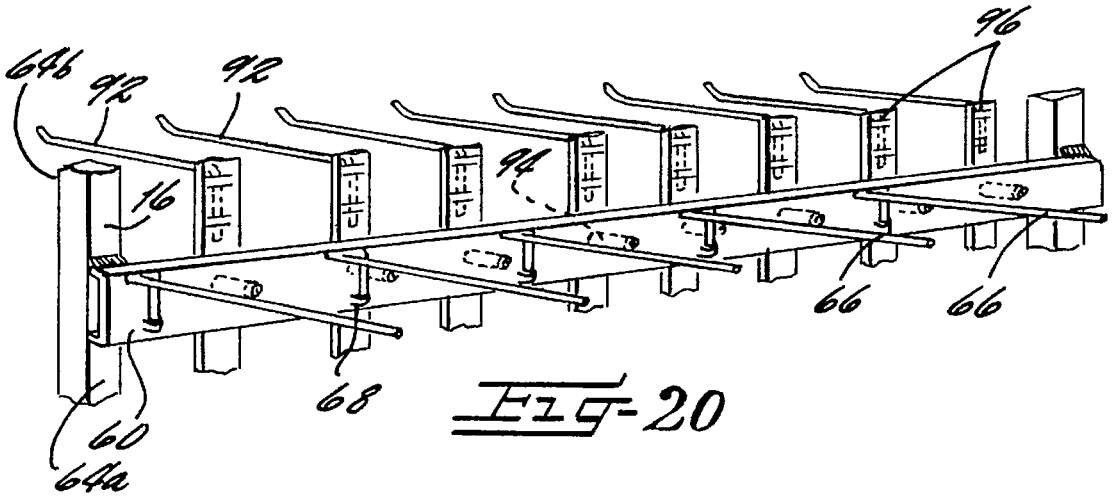
FIG. 20 is an enlarged view of a portion of the end most carrier unit or swatch unit shown in FIG. 19.
Figure 21:
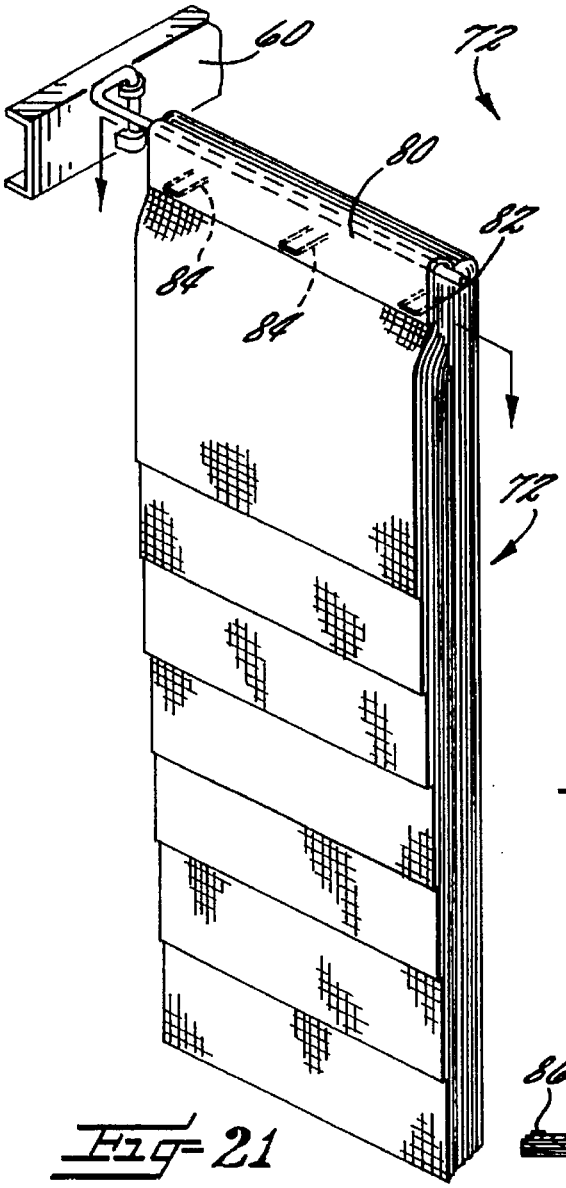
FIG. 21 is a perspective view of a large swatch unit as carried on a hook of a swatch unit.

As discussed above, a modified carrier unit in the form of swatch unit 34 can be provided. The frame of the swatch unit is made in substantially the same manner as the frame 16 for the carrier units 14 designed to hold the rolls of material 28. However, instead of providing roll supports 18, the frame **16*g* is provided with a plurality of horizontally and/or vertically extending supports 60 and 62 respectively. These vertical and horizontal supports 60 and 62 are adapted to receive and maintain a plurality of swatches of material. In a preferred embodiment of the invention, the swatch unit 34 includes a frame 16*g* defining first and second planar faces 64*a* and 64*b* as shown for example in FIG. 19. A plurality of horizontal supports are provided on the first planar face 64*a*. In a preferred form of the invention, these horizontal supports 60 include a plurality of spaced apart hooks 66 extending outwardly from the planar face 64*a*. These hooks 66 are adapted to receive and support a plurality of material swatches thereon. The hooks 66 are spaced apart to a sufficient extent that material swatches of a significant size can be hung therefrom. As shown in FIG. 20, the hooks 66 are desirably configured from a shaped piece of metal or the like. The hook desirably is bent along a first right angle near one of its ends, and is bent along a second angle such that the hook extends out in a direction substantially perpendicular to a plane formed by the portion of the hook forming the first right angle. Outwardly extending channels 68 are provided on said horizontal support 60, which are sized to receive the first angled portion of a hook 66. The hook 66 is then inserted into one of said channels 68 to form outwardly extending hooks from which material swatches can be hung. Due to the configuration of the hooks, they can be pivoted about an axis extending along the portion thereof which is contained within the channels 68**.

The second planar face **64*b* of the swatch unit desirably includes a plurality of vertical supports 62 which are spaced apart along the face. These supports can comprise strips of metal, for example. The supports desirably include a plurality of outwardly extending channels 96 which are sized to readily receive the end portions of hooks 92 slidingly therein. The hooks 92** desirably comprise angled metal wires having upturned end portions, which assists in keeping swatches which are placed on the hooks from sliding off of the hooks.

In a preferred form of the invention, the swatch unit 34 includes hook-carrying horizontal supports 60 on one of its planar faces **64*a* and hook carrying vertical supports 62 on the other of its planar faces 64*b*. The hooks 92 on the second planar face 64*b* are desirably arranged so as to be closer together than the hooks 66 on the other of its faces 64*a*. In this way, large swatch units 72 can be mounted on the hooks 66 which are spaced to a greater extent and smaller swatches 74 can be displayed on the hooks 92 which are spaced more closely together, because they require a smaller amount of space. The horizontal and vertical supports 60 and 62 can be secured to the frame in any conventional manner, and may include spacers 94** therebetween to secure the swatch unit elements together in a stable and secure manner.

Figure 22:
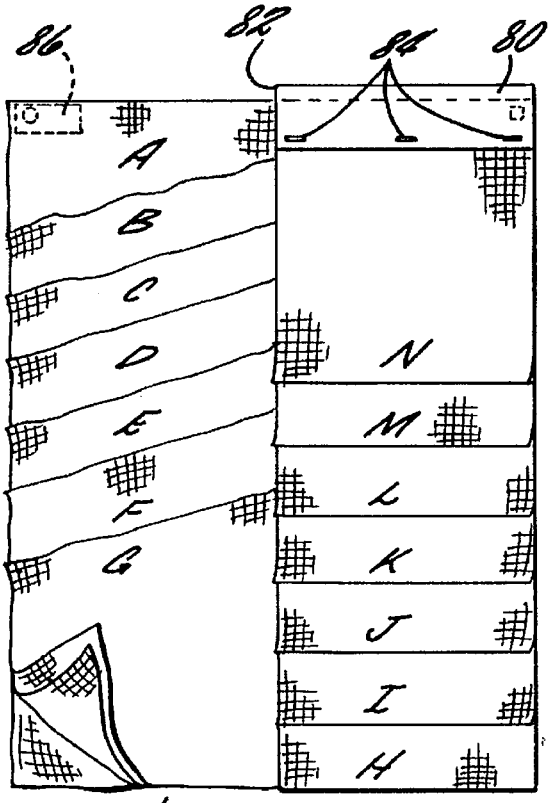
FIG. 22 is another view of the large swatch unit shown in FIG. 21 showing the large swatch unit in its unfolded condition.
Figure 24:
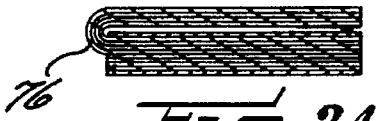
FIG. 24 is a cross sectional view of a large swatch unit in its folded condition as shown in FIG. 21.
Figure 25:
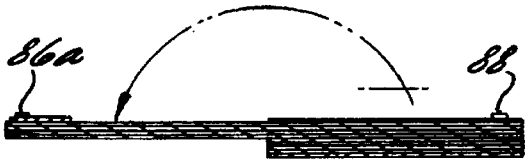
FIG. 25 is a cross sectional view of a large swatch unit in its unfolded condition similar to that shown in FIG. 22.
Figure 23:
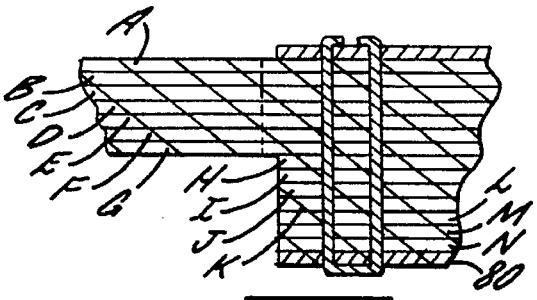
FIG. 23 is a cross sectional view of the large swatch unit shown in FIG. 22.

As shown in FIGS. 21–27, swatch assemblies 72 can be prefabricated to include a plurality of large size swatches of materials. The swatch assemblies include a first plurality of large swatches 76, which are substantially the same shape. These swatches 76, shown generally at A, B, C, D, E, F and G, are stacked on top of each other, as shown in FIG. 22. A second plurality of material swatches 78 is provided, as shown at H, I, J, K, L, M and N. The second plurality of swatches is generally about half as wide as the large swatches 76, and are of staggered lengths in order that the topmost swatch N is shortest and the bottommost swatch H is the longest. In this way, a portion of each of the swatches H–N can be seen when the swatches are stacked one on top of the other. The smaller swatches 78 are then positioned on top of the larger swatches 76 so that two of their sides are in alignment, and first corners of all the swatches are in alignment. A binding 80 is then secured over the top of the smaller swatches 78 and the portion of the larger swatches 76 lying underneath the smaller swatches. The binding 80 is folded loosely thereover and the binding edges are secured by securing means such as staples 84. Because the binding 80 is folded loosely about the fabric swatches A–N, a channel 82 is formed therein.

Figure 28:
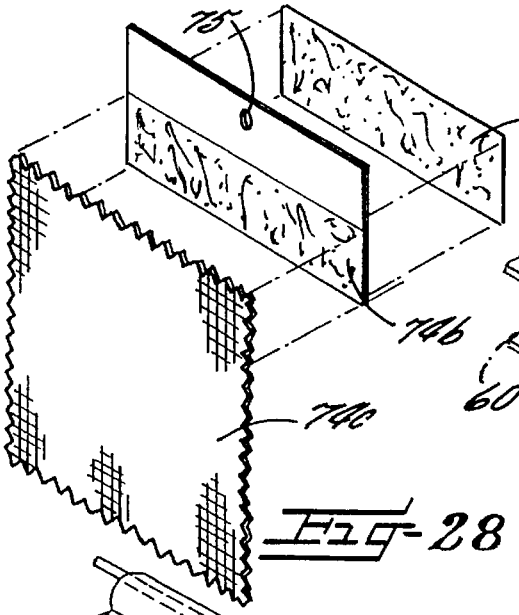
FIG. 28 depicts an exploded view a small swatch unit.
Figure 27:
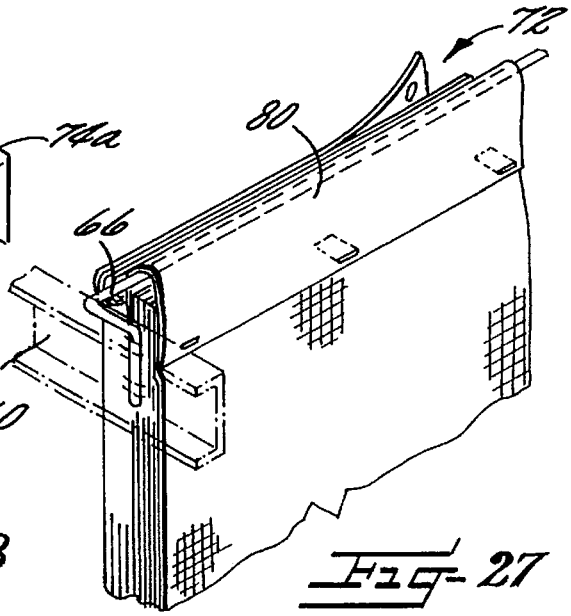
FIG. 27 is another perspective view of the large swatch unit shown in FIG. 26 depicting the other side of the large swatch unit as it is supported on a hook of a carrier unit.
Figure 26:
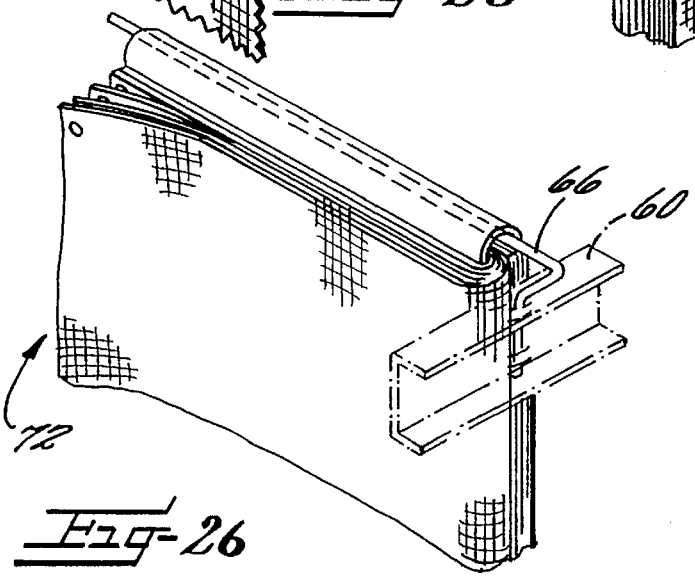
FIG. 26 is a perspective view of a rear portion of a large swatch unit as it appears when supported on a hook of a swatch unit.
Figure 29:
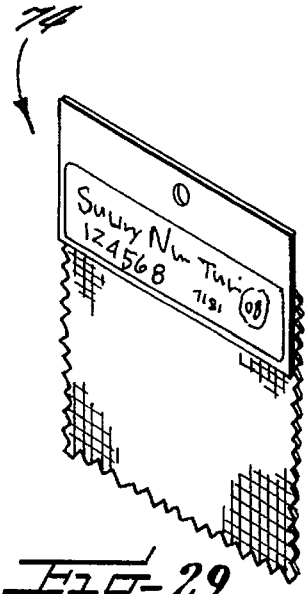
FIG. 29 is a perspective view of an assembled small swatch unit.
Figure 30:
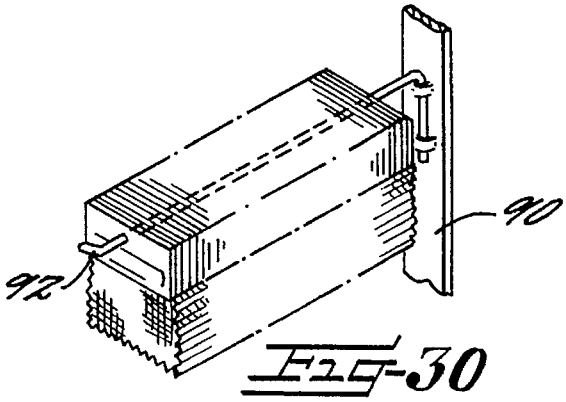
FIG. 30 is a perspective view of a plurality of small swatch units as they appear hanging from a hook of a swatch unit.

Corresponding fasteners 86 and 88 are attached to opposite uppermost corners of the stack of swatches, in order that the stack may be folded longitudinally and attached to itself to secure this folded-over position to form a large swatch assembly 72. The large swatch assembly 72 can then be secured on a swatch unit 34 of the display apparatus by sliding the channel 82 of the large swatch assembly 72 over a hook 66 of the swatch unit. In operation, a consumer can remove a large swatch assembly 72 from the hook 66 and then separate the mating fasteners 86 and 88 to examine the swatches A–N. In a preferred method of the invention, the swatches A–G comprise the same materials as those of H–N. In this way, the smaller swatches H–N can be examined while they are hanging on the swatch unit 34, then when one desires to examine a larger piece of that material he need only remove the swatch assembly 72 from the hook 66 of the swatch unit 34 and unfold the assembly in the manner discussed above. Small swatch assemblies can also be provided to enable a customer to retain small samples of desired materials which can be removed from the store. Customarily, small swatches are obtained by a clerk or consumer snipping a swatch of fabric from the roll of material itself. In addition to being time-consuming and messy, this can result in a loss of significant quantities of material, since the clerk must then cut the material on the roll further to provide an even edge when a customer decides to purchase material from that roll. Therefore, the provision of prefabricated removable swatches represents a significant cost-saving and tidy means of swatch provision. A preferred prefabricated small swatch assembly 74 is illustrated in FIGS. 28–30, and includes a small material swatch 74*c*, a swatch carrier 74*b*, and a label 74*a* which bears information about the material swatch 74*c* such as fiber content, manufacturing construction, care/cleaning instructions and price. A plurality of the small swatch assemblies 74 can be hung on hooks 92 of the swatch unit 34 by threading the hook through a hole 75 in the swatch carrier 74*b*.

Figure 33:
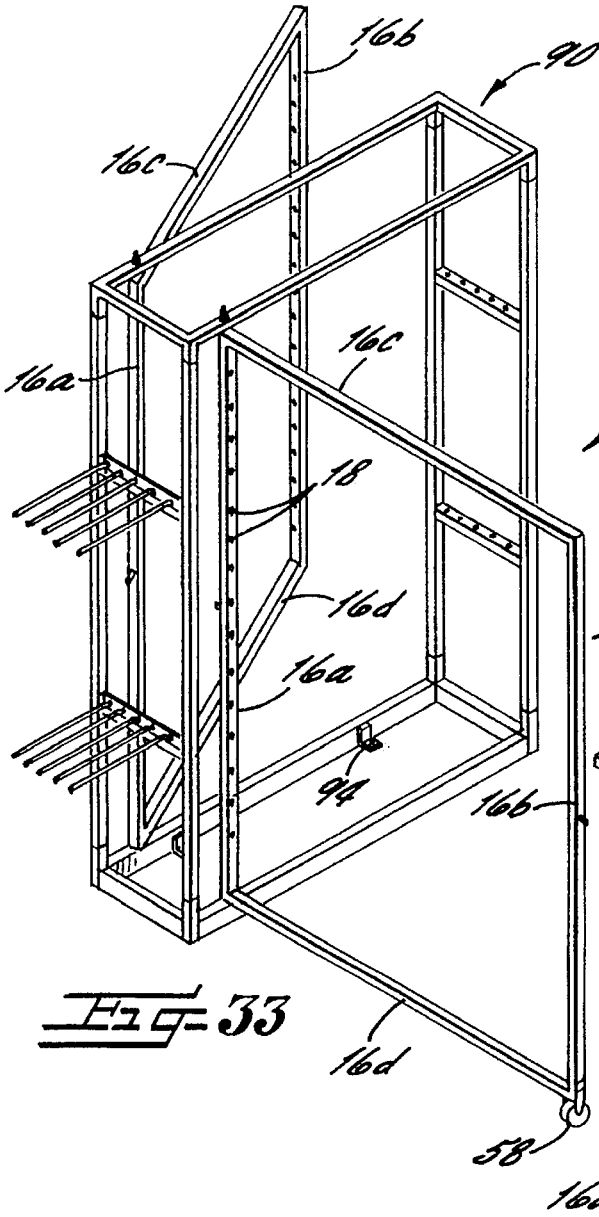
FIG. 33 is a perspective view of a freestanding display rack according to the present invention.
Figure 34:
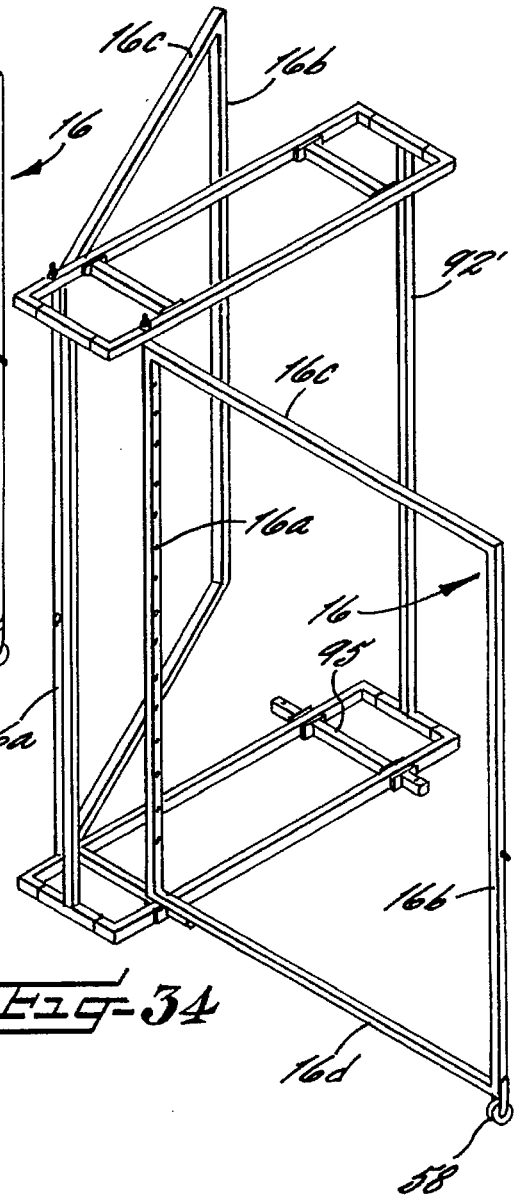
FIG. 34 is a perspective view of an alternative embodiment of the freestanding display rack according to the present invention.

As previously mentioned, the display apparatus of the invention can be provided in freestanding form, as shown generally at 90 in FIGS. 33 and 34. The freestanding carriers comprise a center support 92 and 92' such as a cubic support frame. Carrier unit frames 16 previously discussed with respect to the wall-mounted units are pivotally mounted to the center support 92 so that the frames are pivotally mounted along a vertical axis which extends substantially along a vertical side thereof. The carriers 90 desirably include a plurality of carrier unit frames 16, with the frames being provided on opposite sides of center support 92, 92' so as to extend outwardly therefrom. Each side of the center support 92 desirably includes a plurality of carrier unit frames 16, which have their axes of pivot horizontally spaced a distance less than the width of the frames, in order that adjacent carrier units can overlap when they are pivoted about their respective axes of pivot. The freestanding carriers 90 can also be secured to the floor for added stability using brackets or bars 94, 95 respectively, they may be formed to have sufficient weight so that their position is maintained without the need for supplemental fasteners. The freestanding carriers 90 can also have a modular form as illustrated for positioning a plurality of the freestanding carriers closely adjacent each other.

Additionally, as illustrated in FIGS. 1–36, the present invention also includes methods for displaying rolls of material and methods for dispensing rolls of material. A method of displaying rolls of material preferably includes providing a substantially rectangular frame pivotally mounted along one side thereof on a vertical axis and mounting in vertically spaced relation on the frame a plurality of horizontally extending rolls of material with the mounting being such as to permit unwinding of the material from the rolls.

A method for displaying rolls of material according to the present invention may also include providing a first substantially rectangular frame pivotally mounted along one side thereof on a vertical axis, providing a second substantially rectangular frame pivotally mounted along one side thereof on a vertical axis so that the first and second frames are horizontally spaced at a distance which is less than each of the respective widthwise dimensions of the first and second frames, thereby enabling the frames to overlap when they are pivoted about their vertical axes, and mounting in vertically spaced relation on each of the frames a plurality of horizontally extending rolls of material with the mounting being such as to permit unwinding of the material from the rolls.

A method for displaying rolls of material is also provided which preferably includes mounting a plurality of substantially rectangular frames such that each frame is pivotable about its own vertical axis of pivot which extends substantially along a vertical side of the frame, said axes being spaced apart from each other along a common horizontal plane and mounting on each frame a plurality of horizontally extending rolls of material.

Further, a method for displaying and/or dispensing rolls of material is provided which also preferably includes providing a substantially rectangular frame having rolls of material horizontally mounted thereon, providing a measuring device mounted to the frame and positioned to receive the material from the rolls, and feeding material from a roll to the measuring device for measurement thereof. This method preferably also includes measuring the material as the material is fed to the measuring device and winding the material onto a roll as the material is being measured.

In the drawings and the specification, there have been disclosed typical preferred embodiments of the invention and, although specific terms are employed, the terms are used in a descriptive sense only and not for purpose of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed:

1. An apparatus for displaying rolls of material comprising:

a carrier including a plurality of carrier units, each carrier unit including a substantially rectangular frame having vertical sides, said frame being pivotally mounted about a vertical axis extending substantially along a corresponding one of the vertical sides of said frame, respective vertical axes of said plurality of carrier units being mounted in spaced relation to adjacent vertical axes along said carrier, and said plurality of carrier units being pivotably movable from a normal inward closed position wherein only a portion of each but one of the carrier units is exposed to an outward open position wherein each carrier unit is fully exposed, a plurality of opposing vertical rows of cooperating roll supports positioned along opposing vertical sides of said frame of each of said plurality of carrier units and adapted to support a plurality of correspondingly spaced horizontally disposed rolls of material.

2. An apparatus as defined by claim 1, wherein each of said plurality of carrier units of said carrier comprise a horizontal width and are mounted along a common plane with a horizontal spacing defined between adjacent carrier units, and wherein said plurality of carrier units are spaced so that the horizontal width of said frame of each of said carrier units is greater than the horizontal spacing between respective vertical axes of adjacent carrier units to thereby enable adjacent carrier units to overlap each other when said plurality of carrier units are pivoted about the vertical axes.

3. An apparatus as defined by claim 1, wherein at least one of said plurality of carrier units includes a wheel mounted to a lower end portion of said frame and opposite from the vertical axis along which said frame is pivotally mounted.

4. An apparatus as defined by claim 1, wherein each of said plurality of carrier units includes a plurality of transverse rods having sufficient length to extend across the width of said frame and a transverse size sufficient to supportingly receive rolls of material, said apparatus further comprising cooperatively paired roll supports adapted to receive and maintain said rods in a horizontal position.

5. An apparatus as defined by claim 4, wherein said cooperating roll supports comprise openings positioned in and spaced along said opposing vertical sides, said openings being sized to receive end portions of said rods.

6. An apparatus as defined by claim 1, wherein said cooperating roll supports comprise substantially U-shaped members.

7. An apparatus as defined by claim 1, further comprising a plurality of carriers, wherein said carriers are adapted to be assembled together to form a modular display apparatus.

8. An apparatus as defined by claim 1, further comprising a swatch unit positioned adjacent said plurality of carrier units, said swatch unit including a substantially rectangular frame pivotally mounted about a vertical axis extending substantially along a vertical side of said frame, and a plurality of horizontal supports extending widthwise across said frame, said supports being adapted to receive and display a plurality of swatches of material.

9. An apparatus as defined by claim 1, further comprising a carrier support, said carrier support including an upper horizontally-extending member adapted to be secured to a wall and adapted to support an upper end of each of the pivotally mounted vertical sides of said frames.

10. An apparatus as defined by claim 1, further comprising a carrier support, said carrier support including a lower tract adapted to be secured to a floor and adapted to support a lower end of each of the pivotally mounted vertical sides of said frames.

11. An apparatus as defined by claim 1, further comprising a measuring device for measuring a length of material, said device being mounted to at least one of said carrier units.

12. An apparatus as defined by claim 11, wherein said measuring device comprises a support bar which extends substantially across the width of the frame, a winder cooperating with said support bar for winding a length of material into rolled form, and a counter cooperating with said winder for measuring a length of material being wound into a rolled form to thereby enable said measuring device to measure a length of material from a roll mounted on said carrier unit.

13. An apparatus as defined by claim 1, further comprising a swatch unit positioned adjacent said plurality of carrier units, said swatch unit including a substantially rectangular frame pivotally mounted about a vertical axis extending substantially along a vertical side of said frame, and a plurality of horizontal supports extending widthwise across said frame, said supports including a plurality of hooks arranged to extend outwardly from said frame and being adapted to receive and display a plurality of swatches of material.

14. An apparatus for displaying rolls of material comprising:

a carrier including a plurality of wheeled carrier units, each carrier unit including a substantially rectangular frame having vertical sides, said frame being pivotally mounted about a vertical axis extending substantially along a corresponding one of the vertical sides of said frame and a wheel mounted to a lower end portion of said frame and opposite from the vertical axis along which said frame is pivotally mounted, respective vertical axes of said plurality of wheeled carrier units being mounted along a common plane with a horizontal spacing defined between adjacent carrier units and in spaced relation to adjacent vertical axes along said carrier, said plurality of wheeled carrier units having a horizontal width and also being pivotably movable from a normal inward closed position wherein only a portion of each but one of the carrier units is exposed to an outward open position wherein each carrier unit is fully exposed, said plurality of wheeled carrier units further being spaced so as that the horizontal width of said frame of each of said carrier units is greater than the horizontal spacing between respective vertical axes of adjacent carrier units to thereby enable adjacent carrier units to overlap each other when said plurality of carrier units are pivoted about the vertical axes, a plurality of opposing vertical rows of cooperating roll supports positioned along said vertical sides of said frame of each of said plurality of wheeled carrier units and adapted to support a plurality of correspondingly spaced horizontally disposed rolls of material, said cooperating roll supports comprising openings positioned in and spaced along said opposing vertical sides of said frame, said openings being sized to receive end portions of rods.

15. An apparatus as defined by claim 13, wherein each of said plurality of carrier units includes a plurality of transverse rods having sufficient length to extend across the Width of said frame and a transverse size sufficient to supportingly receive rolls of material, and wherein said cooperating roll supports are adapted to receive and maintain said rods in a horizontal position.

16. An apparatus as defined by claim 14, wherein end portions of said rods are configured to be adapted to be secured within the openings and include a shoulder spaced inwardly from respective ends thereof.

17. An apparatus as defined by claim 13, further comprising a plurality of carriers, wherein said carriers are adapted to be assembled together in a common plane so as to form a modular display apparatus.

18. An apparatus as defined by claim 13, further comprising a carrier support, said carrier support including an upper horizontally-extending member adapted to be secured to a wall and adapted to support an upper end of each of the pivotally mounted vertical sides of said frames and wherein each of the frames includes a rod extending upwardly from its pivotally mounted vertical side, and said upper horizontally-extending member includes a plurality of spaced openings, each of said openings being sized to receive one of said rods therein to thereby support the frames in a vertical orientation.

19. An apparatus as defined by claim 18 wherein said carrier support further includes a lower tract adapted to be secured to a floor and adapted to support a lower end of each of the pivotally mounted vertical sides of said frames and wherein each of the frames includes a rod extending downwardly from a lower end of its pivotally mounted vertical side, and said lower tract includes a plurality of openings, each of said openings being sized to receive one of said rods therein to thereby support the carrier units in their vertical orientation.

20. An apparatus as defined by claim 13, further comprising a measuring device for measuring a length of material, said device being arranged to mount to at least one of said carrier units and comprising a support bar which extends substantially between the vertical sides of the frame, a winder cooperating with said support bar for winding a length of material into rolled form, and a counter cooperating with said winder for measuring a length of material being wound into a rolled form to thereby enable said measuring device to measure a length of material from a roll mounted on said carrier unit.

21. An apparatus as defined by claim 20, wherein each of said frames of said plurality of carrier units includes support members attached thereto, and said measuring device includes mounting members for mounting said measuring device to each of said frames.

22. An apparatus as defined by claim 21, wherein said support members comprise support rods connected to and extending outwardly from said frame of said carrier unit, and said mounting members include slots for receiving the support rods therein.

23. An apparatus for displaying rolls of material comprising:

a substantially rectangular frame pivotally mounted along one side thereof on a vertical axis, and a plurality of opposing vertical rows of cooperating roll supports positioned along opposing vertical sides of the frame and adapted to support a plurality of correspondingly spaced, horizontally disposed rolls of material.

24. An apparatus as defined by claim 23, further comprising a wheel mounted to a lower end portion of said frame and opposite from the vertical axis along which said frame is pivotally mounted.

25. An apparatus as defined by claim 24, further comprising a plurality of transverse rods having sufficient length to extend across a width of said frame and a transverse size sufficient to supportingly receive rolls of material, and wherein said cooperating roll supports are adapted to receive and maintain said rods in a horizontal position.

26. An apparatus as defined by claim 25, wherein said cooperating roll supports comprise openings positioned in and spaced along said opposing vertical sides, said openings being sized to receive end portions of said rods.

27. An apparatus as defined by claim 26, further comprising a carrier support, said carrier support including an upper horizontally-extending member adapted to be secured to a wall and adapted to support an upper end of the pivotally mounted vertical side of said frame.

28. An apparatus as defined by claim 27, wherein said carrier support further includes a lower tract adapted to be secured to a floor and adapted to support a lower end of the pivotally mounted vertical side of said frame.

29. An apparatus as defined by claim 26, further comprising a measuring device for measuring a length of material, said device being mounted to said frame.

30. An apparatus as defined by claim 29, wherein said measuring device comprises a support bar which extends substantially across the width of said frame, a winder cooperating with said support bar for winding a length of material into rolled form, and a counter cooperating with said winder for measuring a length of material being wound into a rolled form to thereby enable said measuring device to measure a length of material from a roll mounted on said frame.

31. A method of displaying rolls of material comprising:

providing a substantially rectangular frame pivotally mounted along one side thereof on a vertical axis; and mounting in vertically spaced relation on the frame a plurality of horizontally extending rolls of material with the mounting being such as to permit unwinding of the material from the rolls.

32. A method of displaying rolls of material comprising:

providing a first substantially rectangular frame pivotally mounted along one side thereof on a vertical axis;

providing a second substantially rectangular frame pivotally mounted along one side thereof on a vertical axis so that the first and second frames are horizontally spaced at a distance which is less than each of a respective widthwise dimensions of the first and second frames, thereby enabling the frames to overlap when they are pivoted about their vertical axes; and mounting in vertically spaced relation on each of the frames a plurality of horizontally extending rolls of material with the mounting being such as to permit unwinding of the material from the rolls.

33. A method of displaying rolls of material comprising:

mounting a plurality of substantially rectangular frames such that each frame is pivotable about its own vertical axis of pivot which extends substantially along a vertical side of the frame, said axes being spaced apart from each other along a common horizontal plane; and mounting on each frame a plurality of horizontally extending rolls of material.

34. A method of displaying and dispensing rolls of material comprising:

providing a substantially rectangular frame having rolls of material horizontally mounted thereon;

providing a measuring device mounted to the frame and positioned to receive the material from the rolls; and feeding material from a roll to the measuring device for measurement thereof.

35. A method as defined by claim 34, further comprising:

measuring the material as the material is fed to the measuring device; and winding the material onto a roll as the material is being measured.

* * * * *